US007284406B2

(12) United States Patent
Krauss

(10) Patent No.: US 7,284,406 B2
(45) Date of Patent: Oct. 23, 2007

(54) TUBE END FORMING AND COPING METHOD AND APPARATUS

(76) Inventor: Robert Krauss, 4218 W. 176th St., Torrance, CA (US) 90504

( * ) Notice: Subject to any disclaimer, the term of this patent is extended or adjusted under 35 U.S.C. 154(b) by 0 days.

(21) Appl. No.: 11/119,271

(22) Filed: May 2, 2005

(65) Prior Publication Data

US 2006/0243018 A1 Nov. 2, 2006

(51) Int. Cl.
*B21D 41/00* (2006.01)

(52) U.S. Cl. ..... 72/370.1; 72/70; 72/125

(58) Field of Classification Search ..... 72/70, 72/71, 324, 370.1, 464, 121, 125; 29/560, 29/56.5

See application file for complete search history.

(56) References Cited

U.S. PATENT DOCUMENTS

| | | | | |
|---|---|---|---|---|
| 1,582,525 | A * | 4/1926 | Lucas | 72/84 |
| 4,606,249 | A * | 8/1986 | Hayes et al. | 82/158 |
| 5,956,987 | A * | 9/1999 | Anthoine | 72/21.5 |
| 6,047,584 | A * | 4/2000 | Filippo | 72/116 |
| 6,233,993 | B1 * | 5/2001 | Irie | 72/121 |
| 6,427,508 | B1 * | 8/2002 | Lehto et al. | 72/71 |

* cited by examiner

*Primary Examiner*—Daniel C Crane
(74) *Attorney, Agent, or Firm*—Irving Keschner

(57) ABSTRACT

Apparatus for both forming and coping the end of a tube. The tube is gripped such that it is aligned with a movable first tool assembly that is positioned, in a first operation, adjacent said tube end. The tool assembly is then controlled in a manner such that the tube end is formed. Thereafter, the first tool assembly is removed and replaced with a second tool assembly which is controlled in a manner such that the formed tube end is then coped. The movable tool assembly is rotatable about its axis to a predetermined plane.

4 Claims, 29 Drawing Sheets

FIG. 26
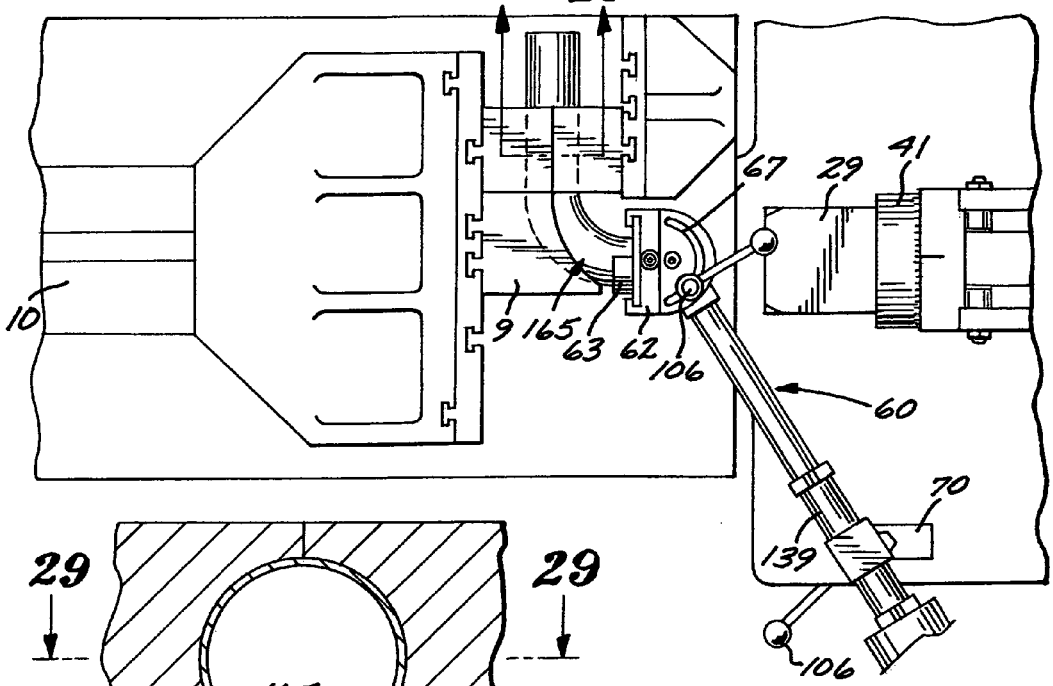
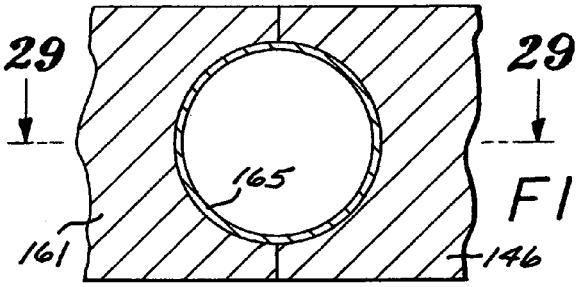
FIG. 27
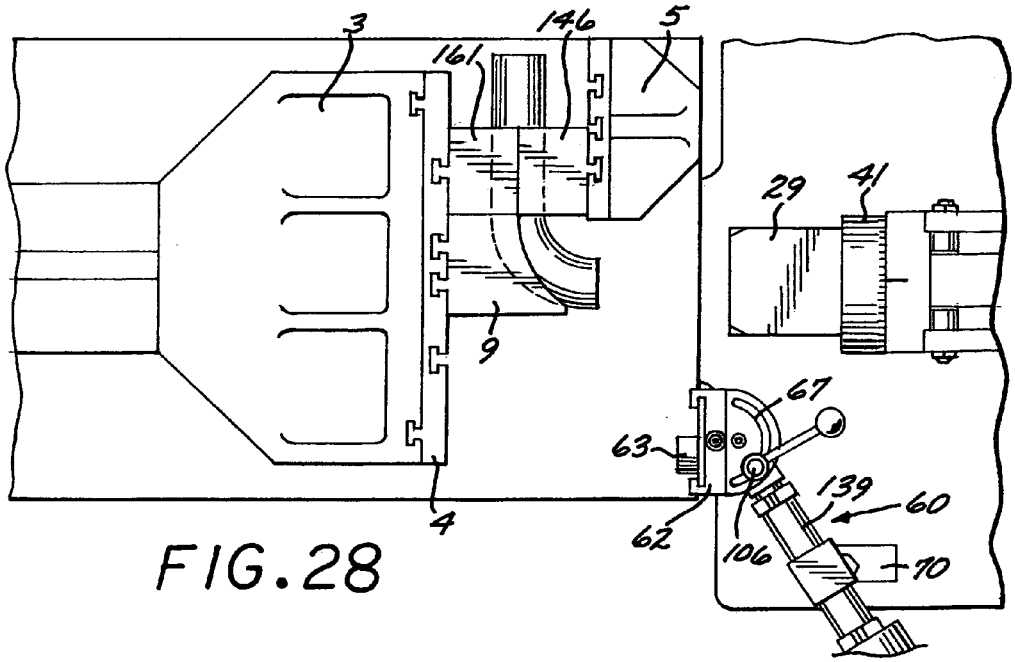
FIG. 28

FIG. 29
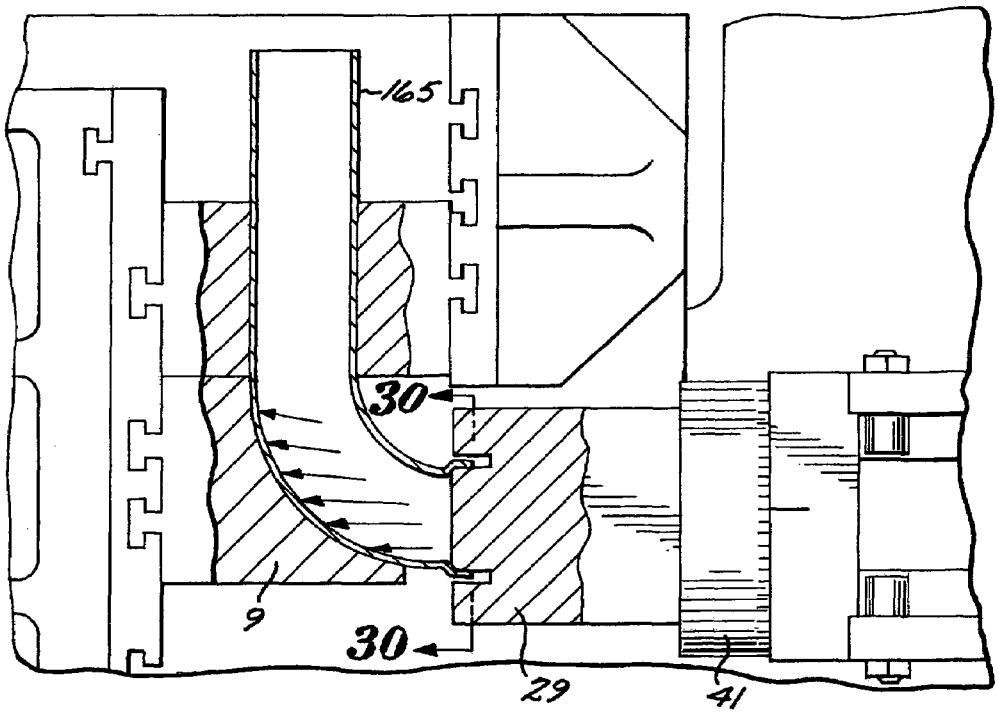
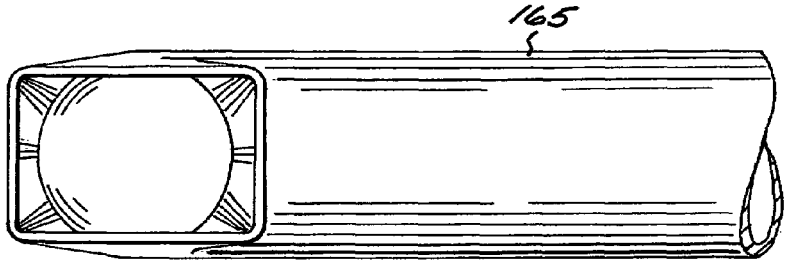
FIG. 30
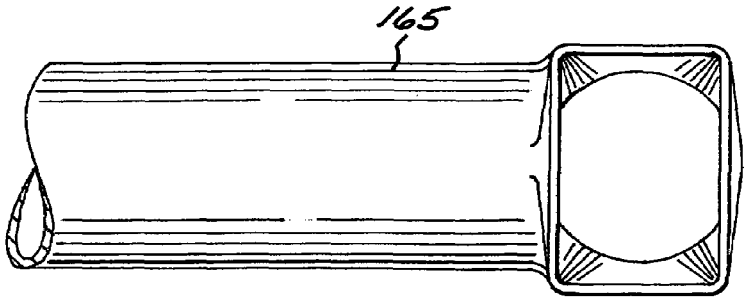
FIG. 31

FIG.45
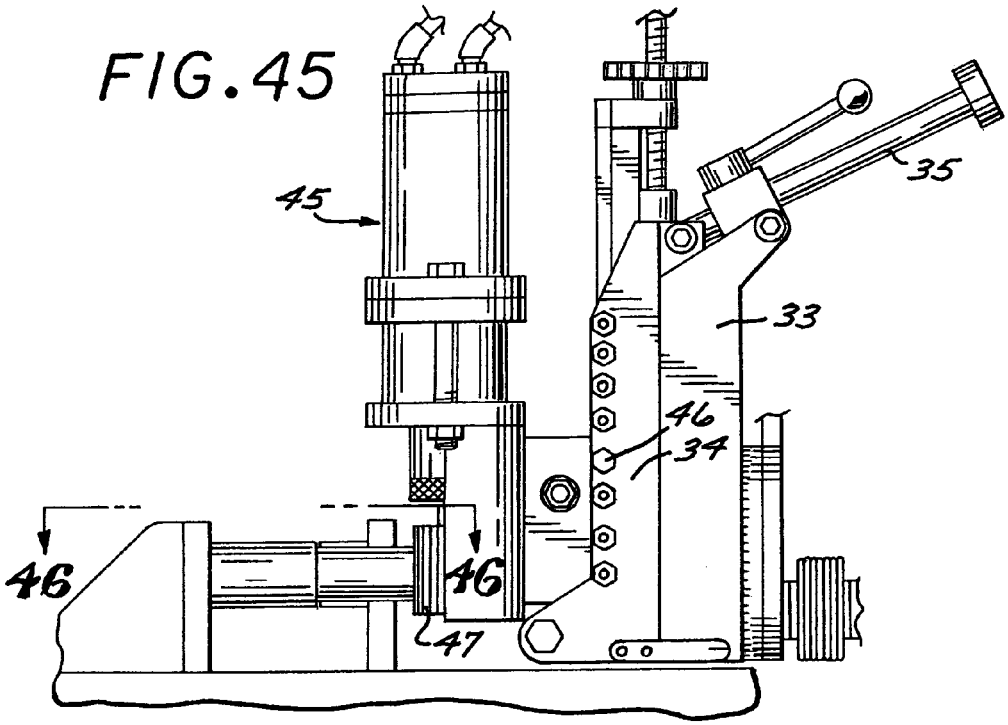
FIG.46
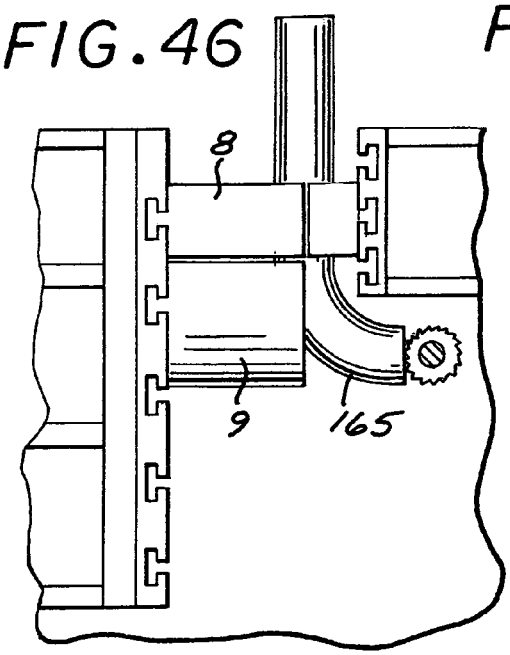
FIG.47
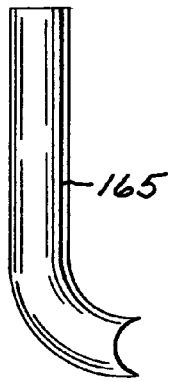
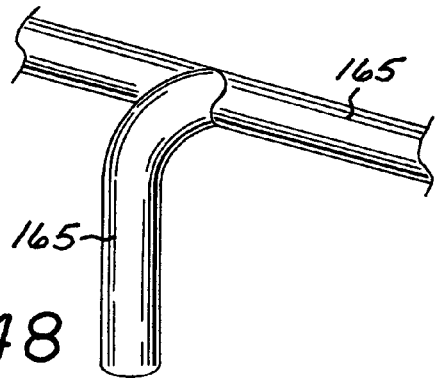
FIG.48

TUBE END FORMING AND COPING METHOD AND APPARATUS

BACKGROUND OF THE INVENTION

1. Field of the Invention

The present invention provides an apparatus for fabricating tubes and, in particular, apparatus for both forming and coping, or cutting, tube ends on any plane of bend.

2. Description of the Prior Art

Currently there are a wide variety of machines available for straight tube end forming. There are also a number of machines designed for straight tube end coping sch as disclosed in U.S. Pat. No. 5,118,228 to Story. However, a machine that can perform both tasks is currently unavailable. In addition, a machine capable of forming tube ends in the bend section is also not available. Current manufacturers use a wide variety of techniques and tooling to form round tubing in a bent section. Typically, special tooling is designed to produce a specific part. This is very expensive and only practical when producing large quantities of parts since tooling cost is high and setup time is excessive. Manufacturers are using methods such as heating tubes with a torch and hammering them into a desired shape and techniques which incorporate tools with clamps that are hydraulically actuated to either expand or reduce a part to the desired shape such as disclosed in U.S. Pat. No. 5,810,054. This type of tooling is expensive, and has limited value since some parts require forming deep into the bend section close to where the tube becomes straight, making this type of tooling ineffective.

What is thus desired is to provide a technique for finishing tube ends which overcome the disadvantages noted above and, in particular, provides an apparatus which can combine tube end forming and coping techniques.

SUMMARY OF THE INVENTION

The present invention provides a process for changing the shape of a tube in the bend area to enable the tube to be inserted, for example, into an irregularly shaped exhaust header flange. In addition, the invention provides for a one step compound end forming on any plane of bend.

This feature provides the ability to form a part for an extremely tight exit from a header flange. This is crucial when designing headers where space constraints are limiting, a difficult task for header manufacturers. As noted above, some of the prior art accomplished this by using a ram to force a die assembly into and over a tube to produce the desired shape using tooling which is relatively expensive to fabricate. The present invention allows an exhaust header manufacturer to pre-form tubular parts for easy assembly and welding, eliminating the need for labor-intensive hand forming.

The machine process of the present invention provides a new capability of coping a tube end. This feature allows parts to be cut on virtually any angle in a bend for complex tubular assemblies, particularly attractive to race-car chassis builders since designs are constantly changing. The machine is thus capable of a wide variety of tube end-finishing procedures.

The machine in an embodiment that has been successfully utilized, has a capacity of 3" mild steel tubing with a 0.065" wall and parts with a centerline radius of up to 6" in most cases. Because of its radial arm design, the machine is capable of end forming and coping tubes with up to 180 degrees of bend. The compound tool holder in combination with the ability to move a part from one side of the clamping table to the other allows forming up to 30 degrees on any 360 plane of bend.

Some of the specific features of the machine of the present invention include the following:

(1) Tube grips for all diameters that are designed with the same thickness when placed together so tool changes can be made with little or no clamping pressure changes required.

(2) Forming and coping tools that are adjusted vertically and angularly using hand screws and locking knobs for rapid set ups.

DESCRIPTION OF THE DRAWINGS

For a better understanding of the present invention as well as other objects and further features thereof, reference is made to the following description which is to be read in conjunction with the accompanying drawing therein.

Figure 4:
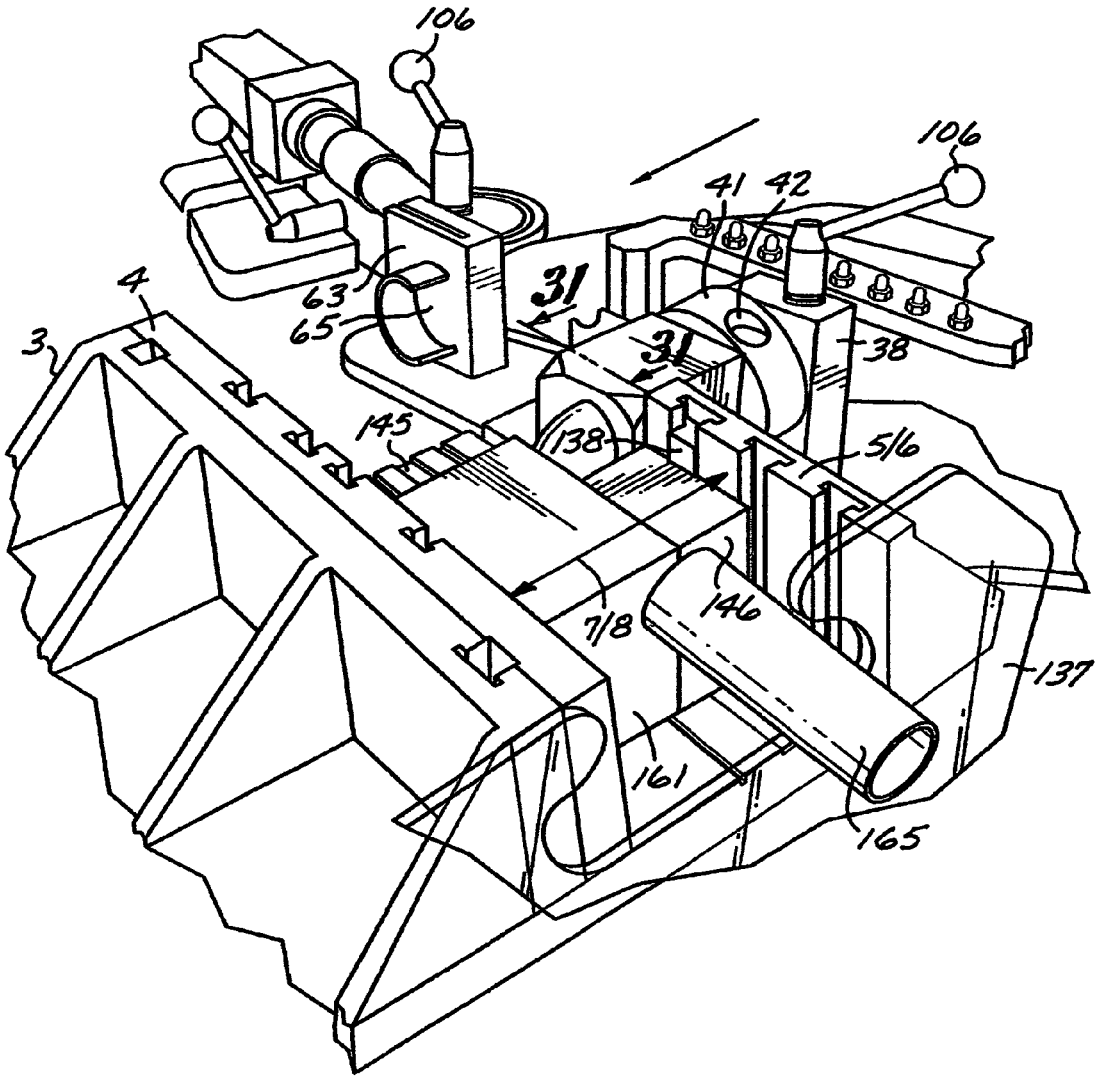
FIG. 4 is a partial perspective view similar to FIG. 2 with the forming tool moved inwards to form the end of the tube.
Figure 21:
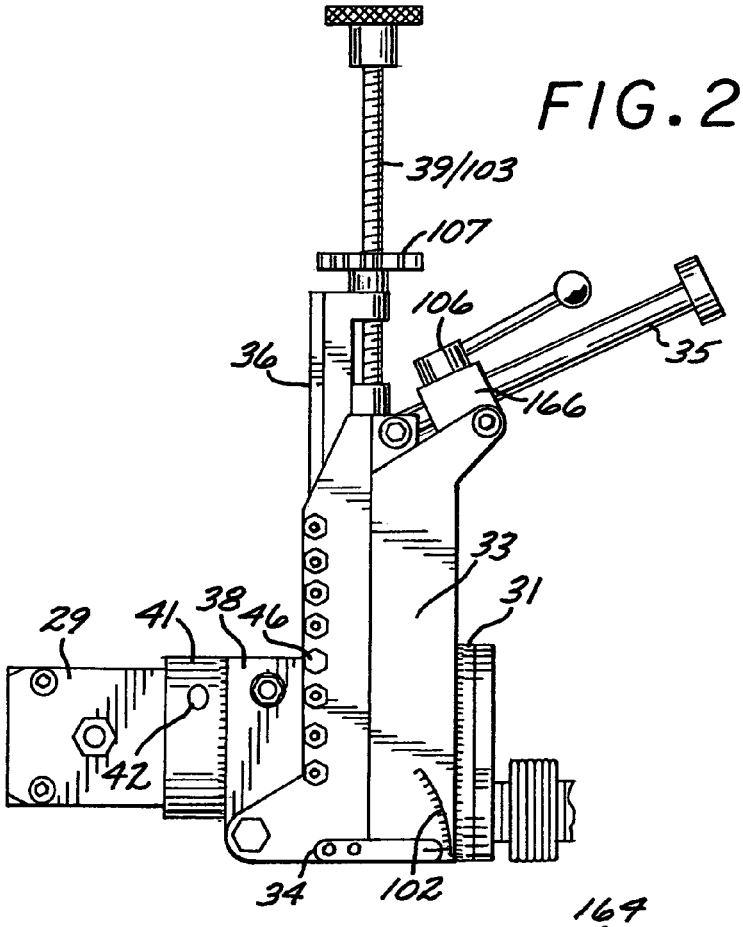
FIG. 21 is a side view similar to FIG. 12 showing a non-threaded compound angle adjustment rod.
Figure 22:
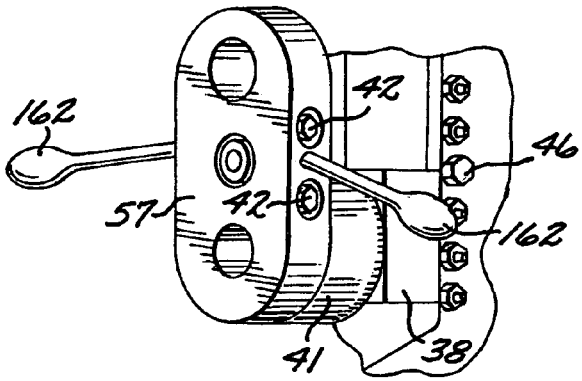
FIG. 22 is a perspective view of the flanging and insert tool.
Figure 23:
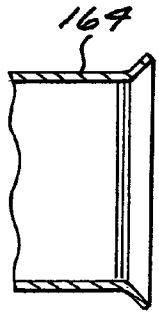
FIG. 23 is a cross-sectional view of the end of a tube that has been flanged.
Figure 23A:
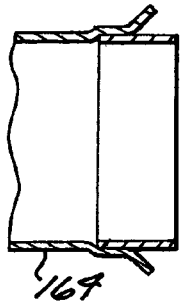
Figures 24, 25:
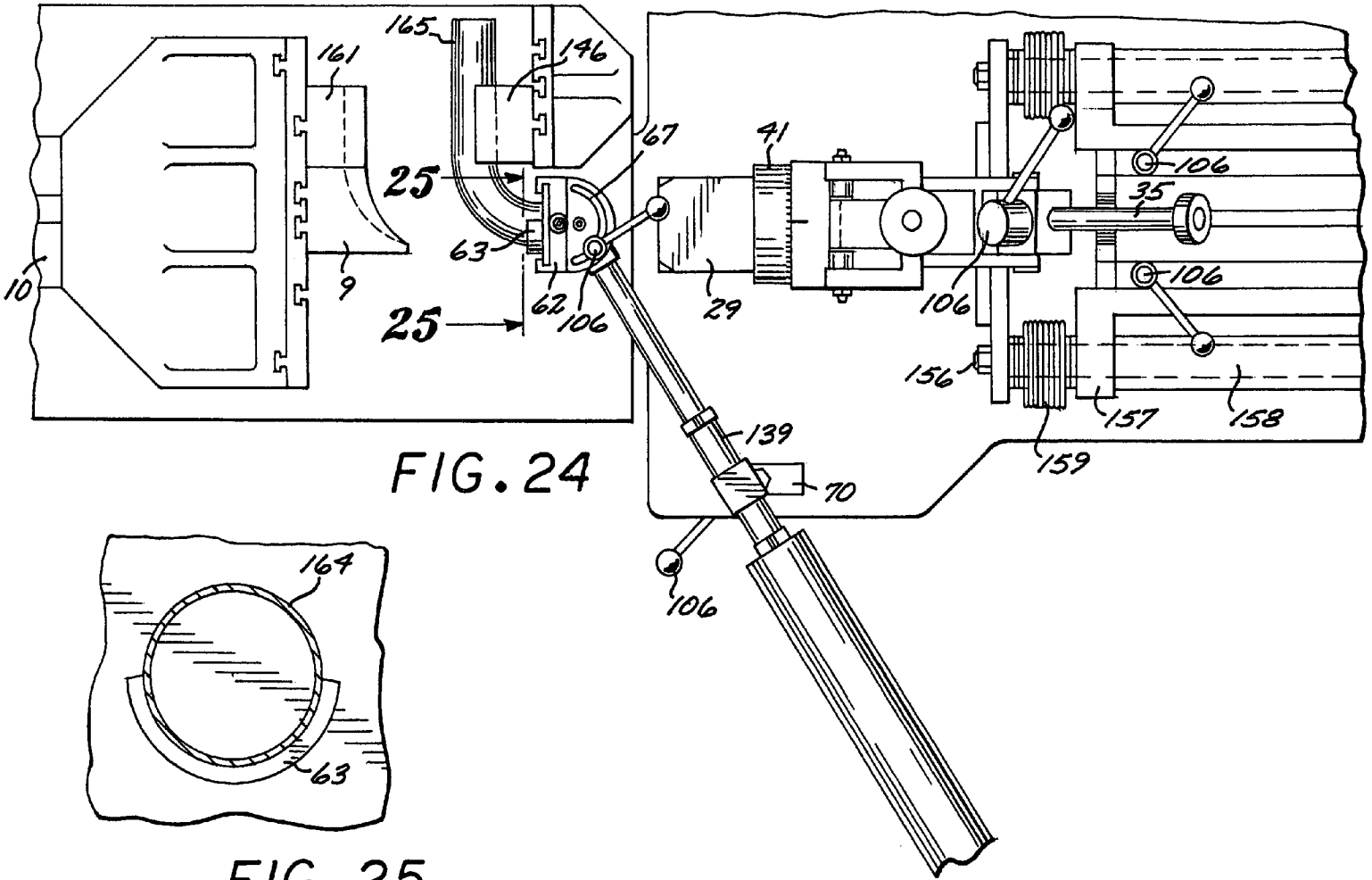
FIG. 24 is a schematic top plan view of the apparatus of the present invention with a tube in place for gripping.
Figure 32:
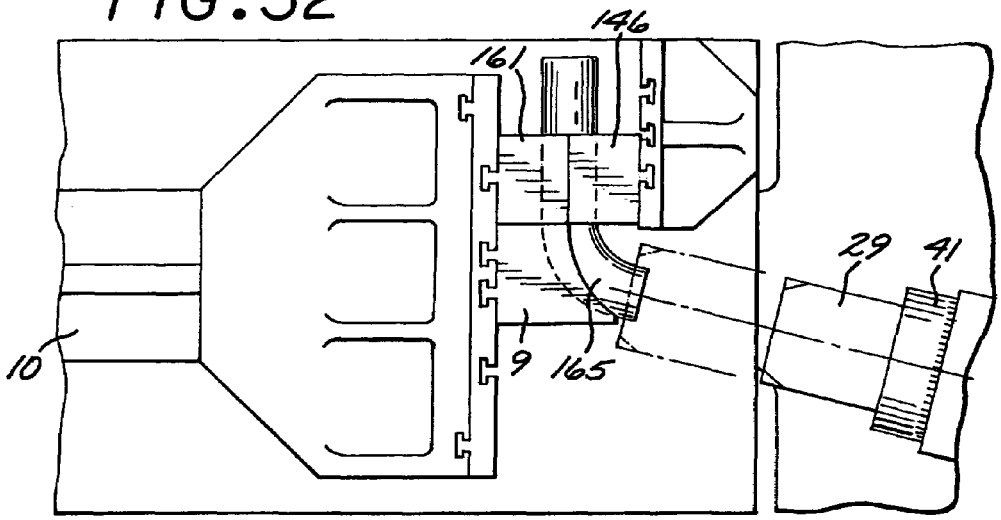
Figure 33:
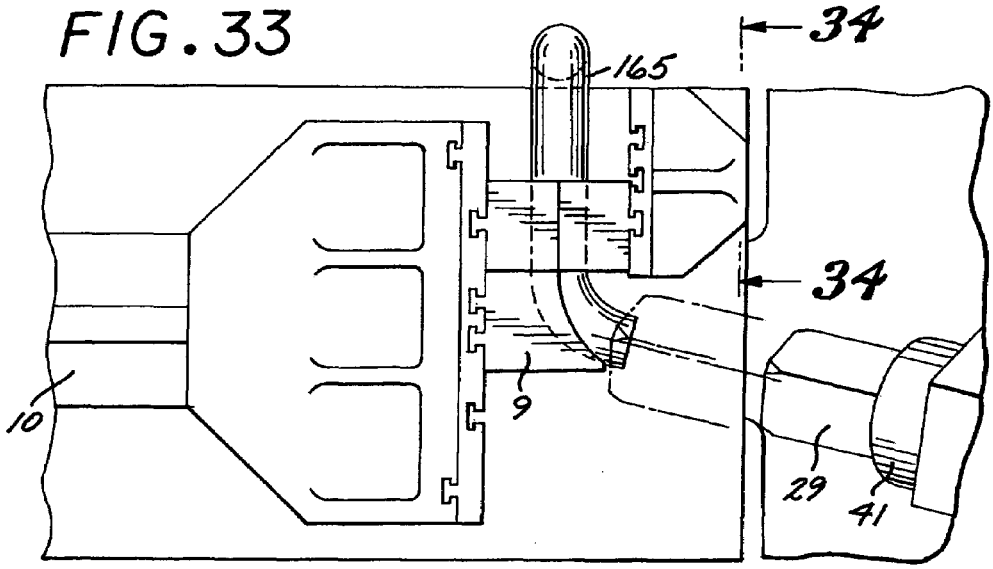
Figure 34:
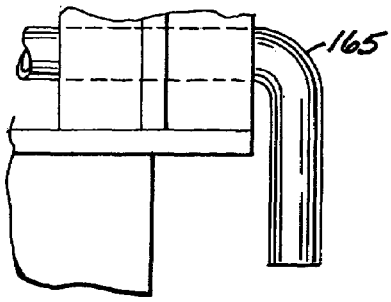
Figure 35:
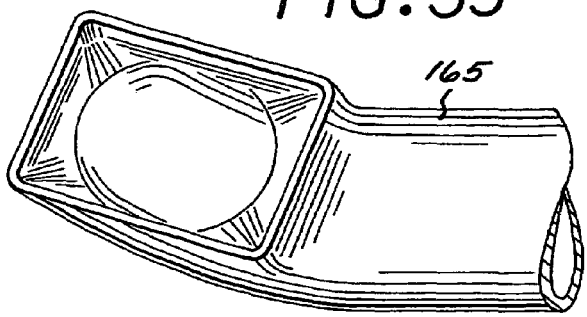
Figure 36:
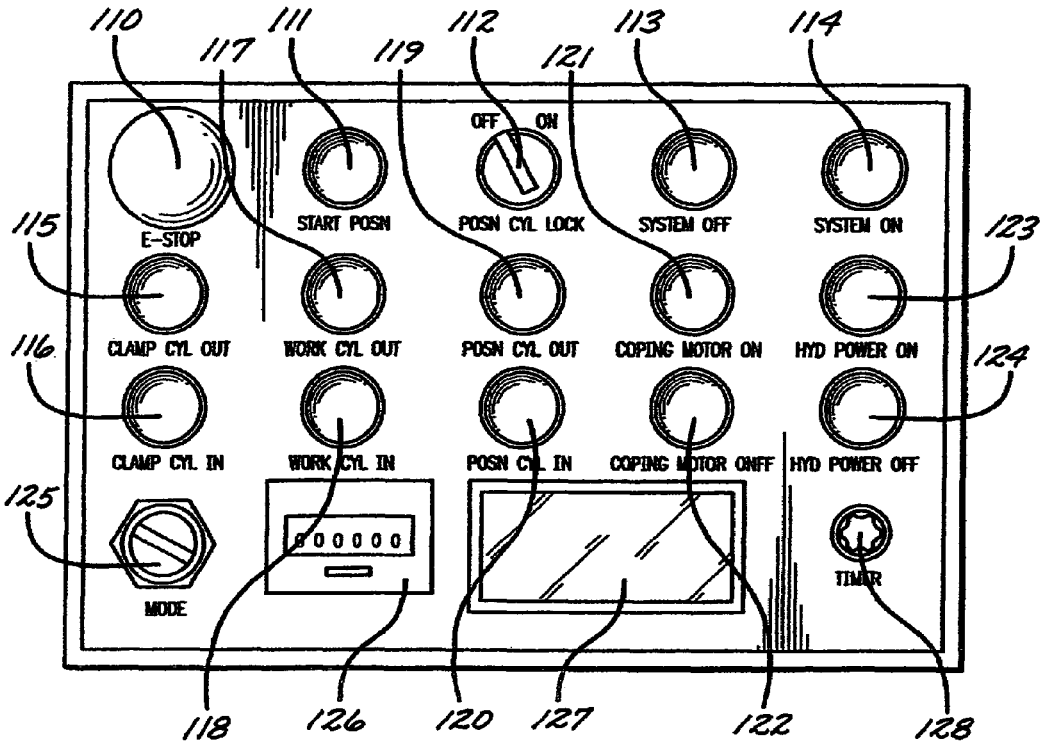
Figure 37:
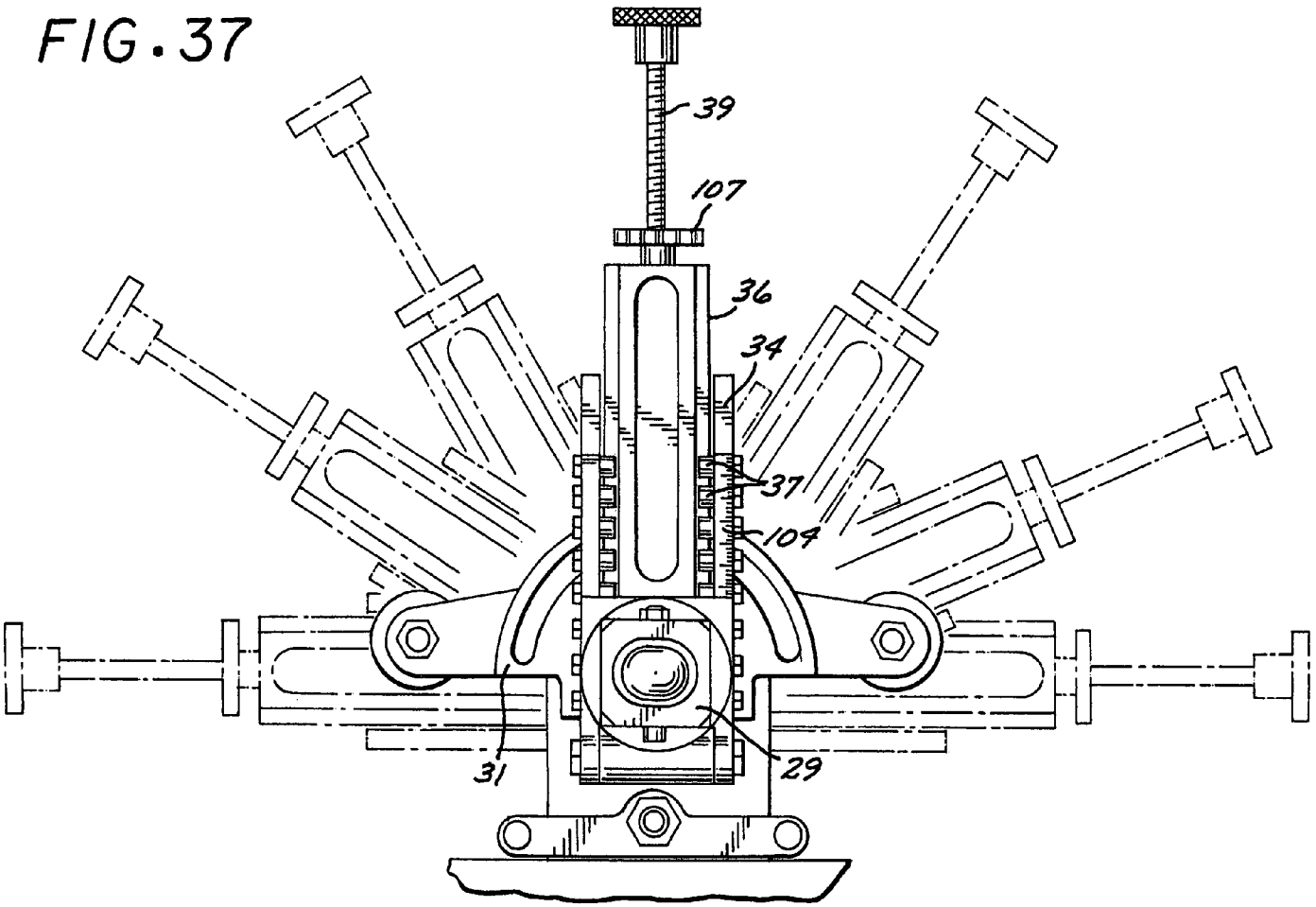
Figure 38:
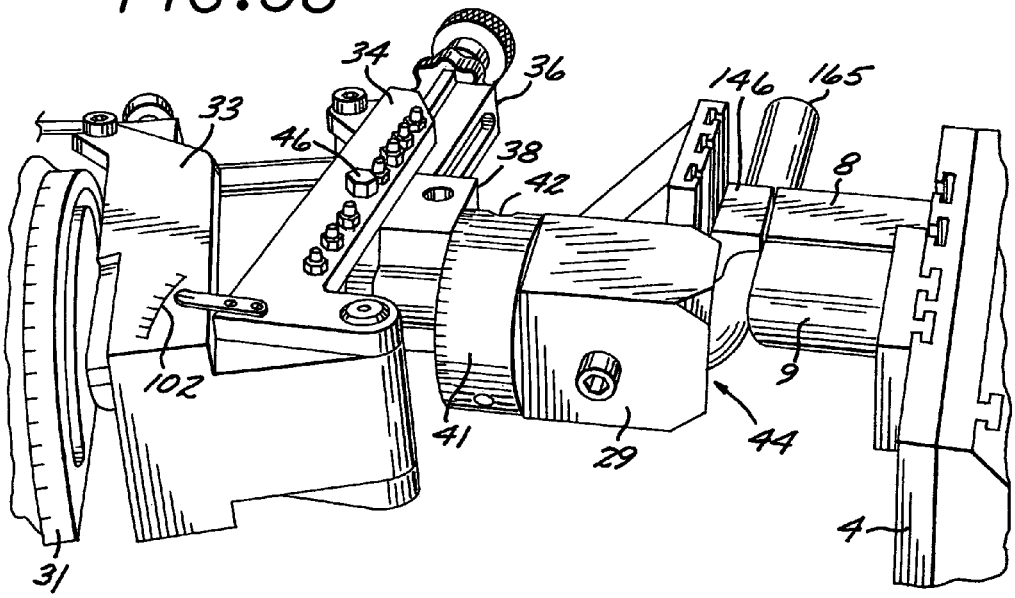
Figure 39:
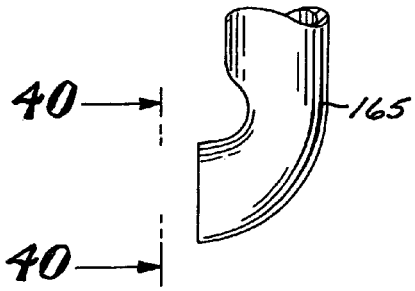
Figure 40:
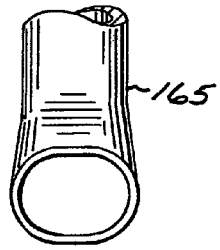
Figure 41:
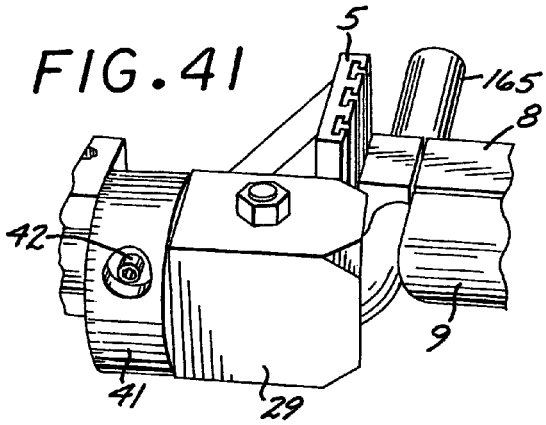
Figure 42:
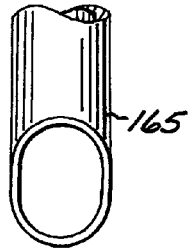
Figure 43:
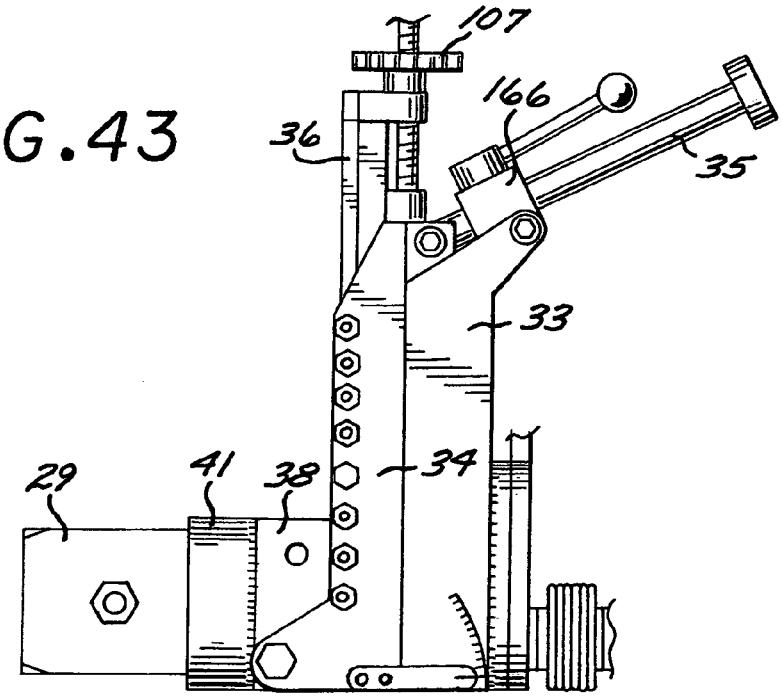
Figure 44:
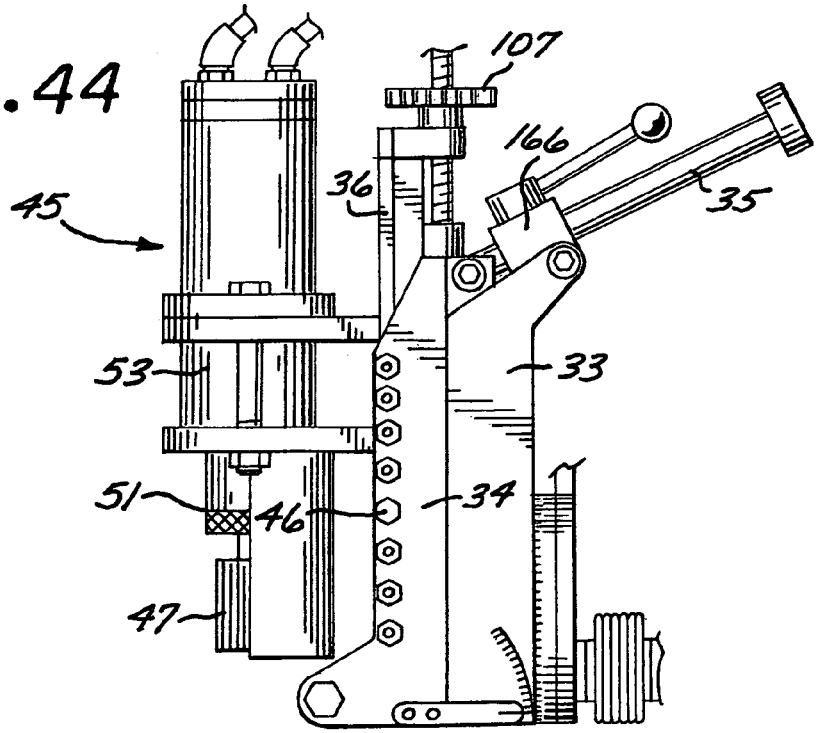
Figure 49:
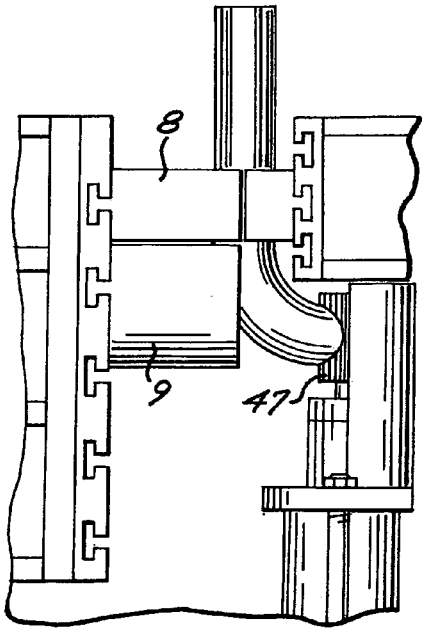
Figure 50:
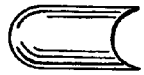
Figure 51:
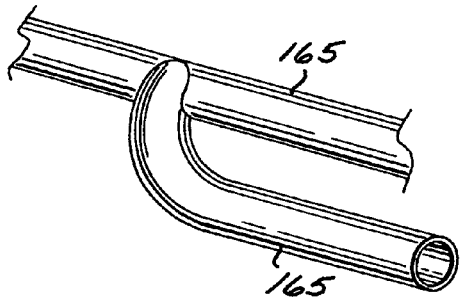
Figure 52:
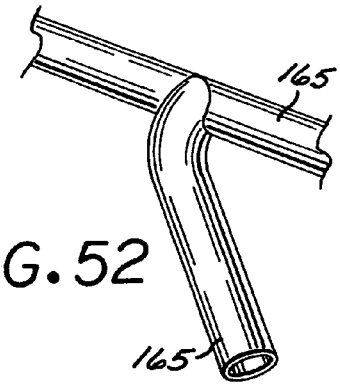
Figure 53:
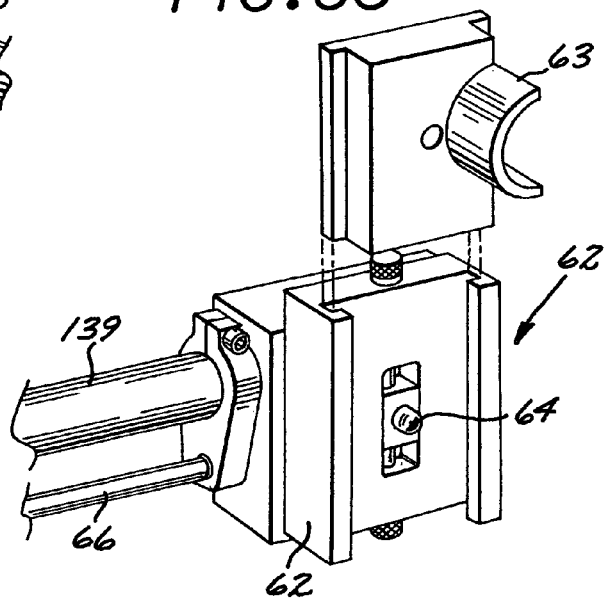
Figure 54:
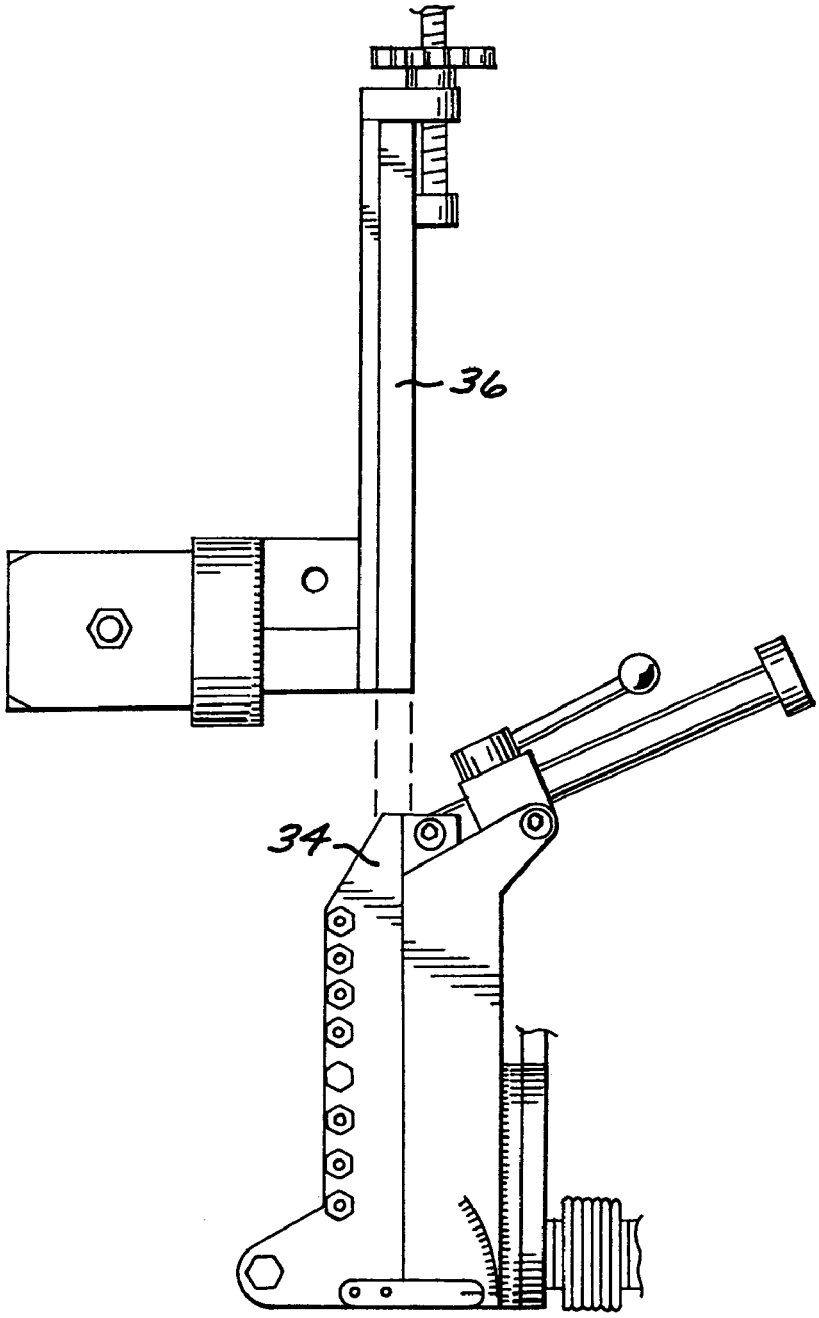
Figure 55:
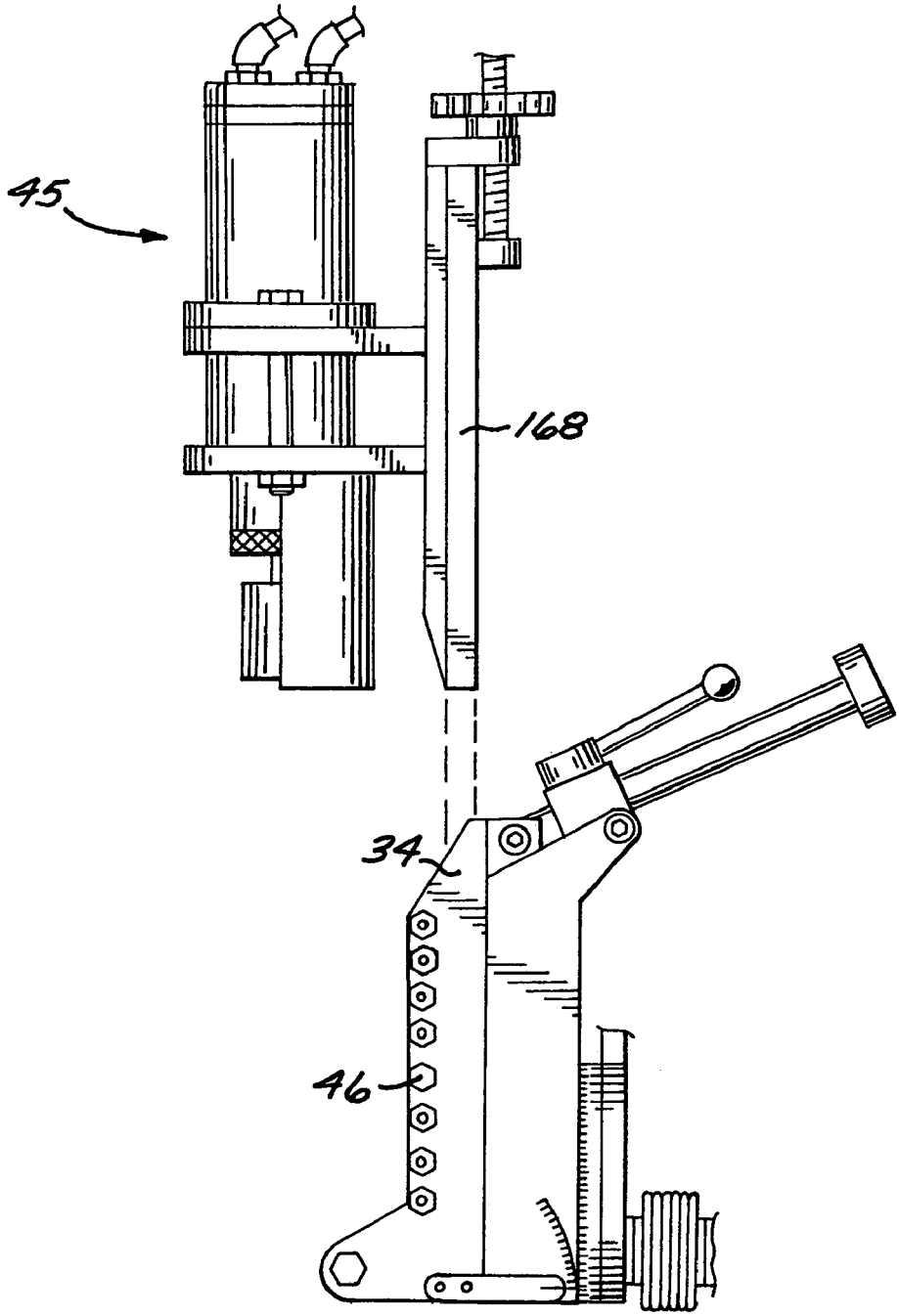
Figure 56:
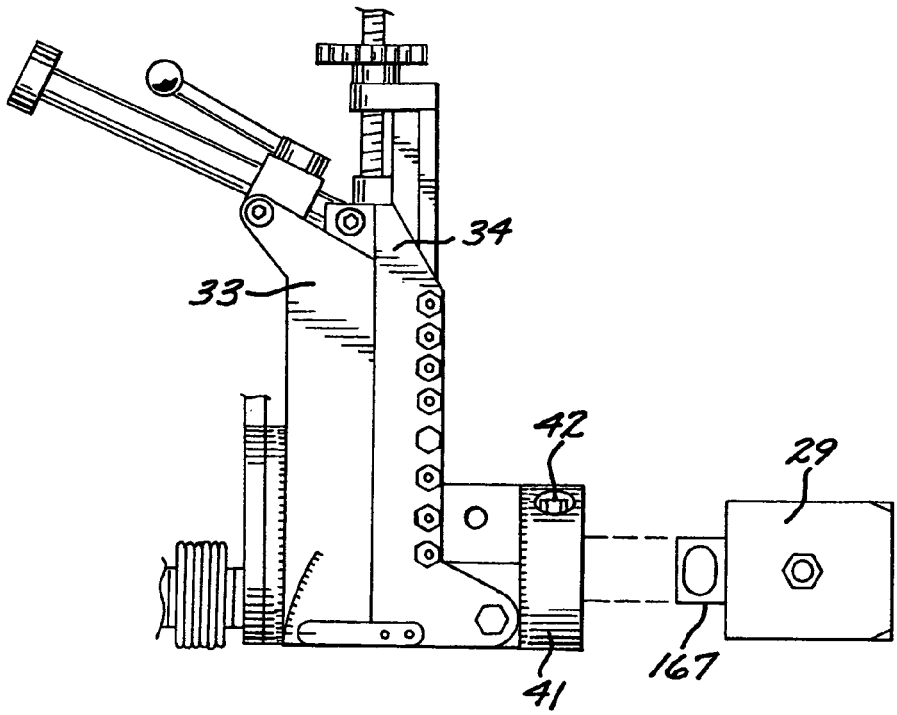

Note that FIGS. 25-35 that follow illustrate the process steps required for forming and coping the end of the tube in accordance with the teachings of the invention;

FIG. 25 is a cross sectional view taken on line 25-25 of FIG. 24 to show the tube end locater tool locating the tube to be formed;

FIG. 26 is a schematic top plan view showing the movable gripper positioned and gripping the tube;

FIG. 27 is a cross sectional view taken on line 27-27 of FIG. 26 showing how tube is griped between the stationery gripper and the moveable gripper;

FIG. 28 is a schematic top plan view with the tube end locater retracted;

FIG. 29 is a schematic enlarged top plan view partly in cross section showing the end of the tube being formed;

FIG. 30 is a plan view of the formed end of the tube taken on line 30-30 of FIG. 29 with the forming head removed so the tube can be seen clearly;

FIG. 31 is a plan view of the formed end of the tube, taken on line 31-31 of FIG. 4 with the forming head, which has been rotated 90 degrees from that shown in FIG. 30, with the forming head removed;

FIG. 32 is a schematic top plan view showing the forming head positioned at an angle to form the tube end;

FIG. 33 is a schematic top plan view as in FIG. 32 with the forming head illustrated at an oblique angle;

FIG. 34 is a view taken on line 34-34 of FIG. 33 to show the tube set in the grips and formed;

FIG. 35 is a plan view of the formed head at an oblique angle;

FIG. 36 is a plan view of the apparatus control panel;

FIG. 37 is a view along line 37-37 of FIG. 21 showing the tool head being rotated to different positions;

FIG. 38 is a perspective view of the tool head rotated and tilted for forming;

FIG. 39 is a plan view of a formed tube end;

FIG. 40 is an end view of the tube end shown in FIG. 39;

FIG. 41 is a perspective view showing the forming head rotated;

FIG. 42 is an end view illustrating the formed pipe after rotation of the forming head;

FIG. 43 is a plan side view of the forming head attached to the holder;

FIG. 44 illustrates the coping tool installed in the tool holder;

FIG. 45 is a side view of the coping tool installed ready to cut into a pipe;

FIG. 46 is a top view taken on line 4646 of FIG. 45;

FIG. 47 is a plan view of a pipe after being coped;

FIG. 48 is a perspective view of a coped pipe fit into another pipe;

FIG. 49 is a top plan view of the coping tool rotated to cope pipe in a different plan;

FIG. 50 is a bottom view of a pipe showing coping;

FIG. 51 shows the coped pipe of FIG. 50 fitted to another pipe;

FIG. 52 illustrates a pipe coped at an oblique angle and fit to another pipe;

FIG. 53 is a perspective view of the tube end locator;

FIGS. 54 and 55 illustrate the changeover from the forming step to the coping step; and FIG. 56 illustrate the insertion of a forming die into the tool holder.

DESCRIPTION OF THE INVENTION

Figure 1:
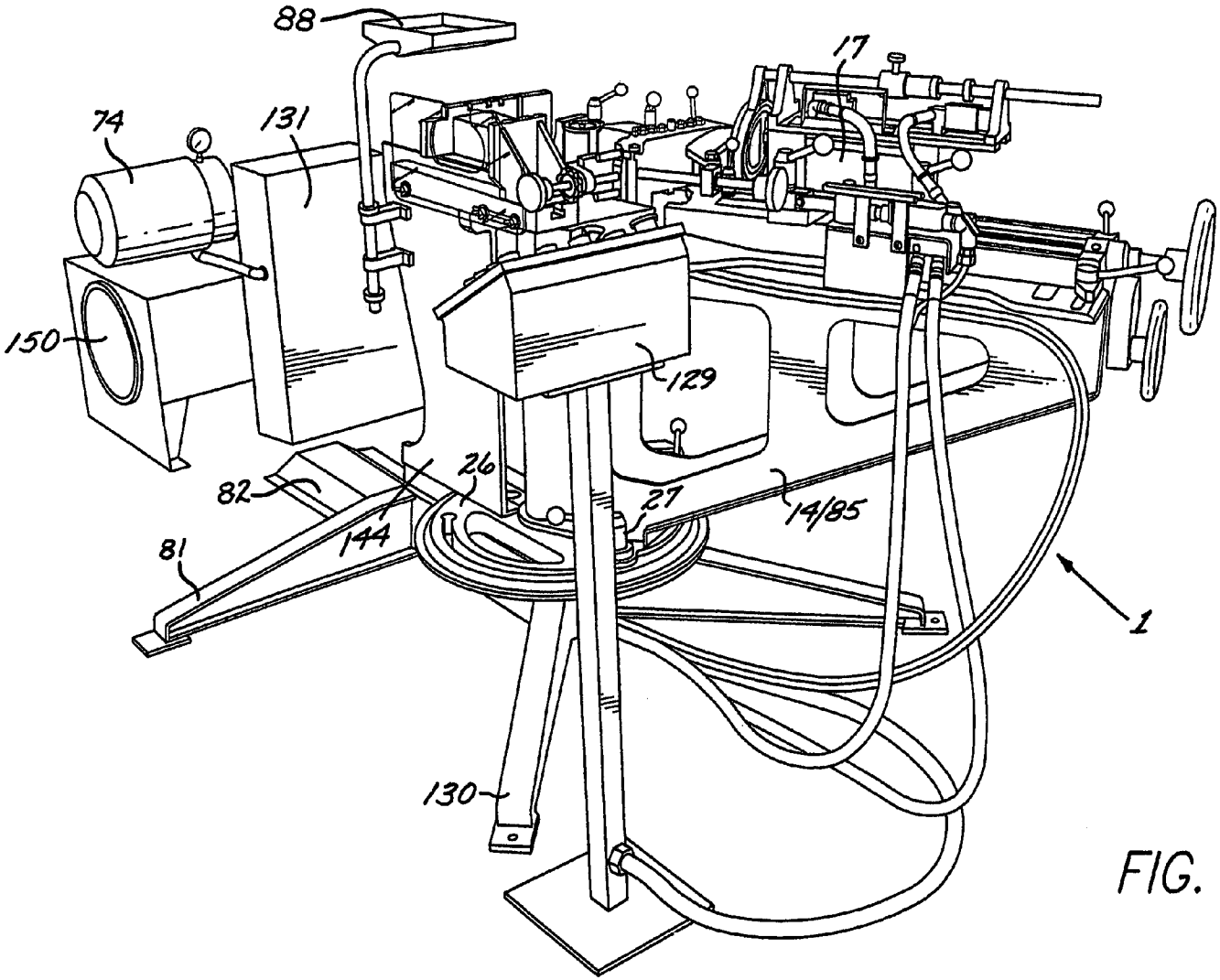
FIG. 1 is a perspective view of the over all tube forming machine of the present invention.
Figure 2:
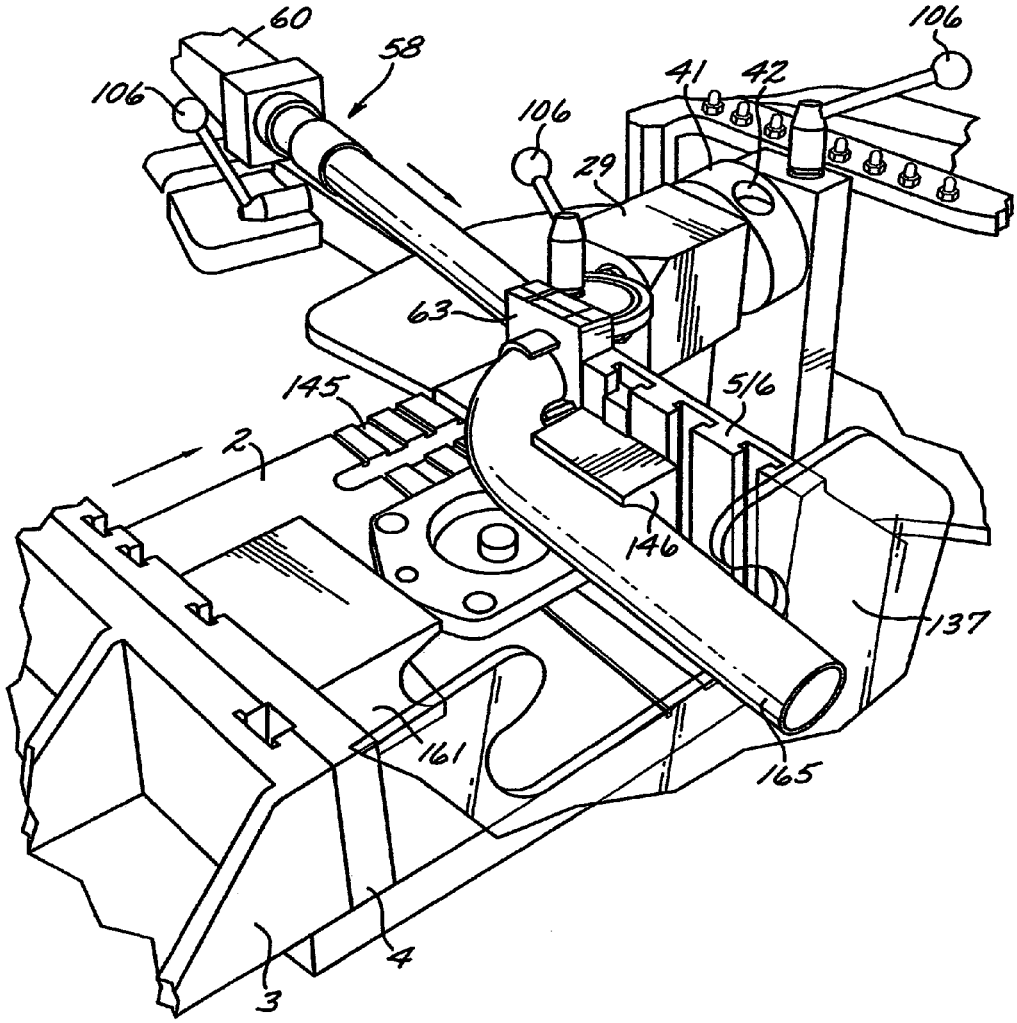
FIG. 2 is a partial perspective view of the forming area showing the tube to be formed located in place by the tube end locator tool.
Figure 3:
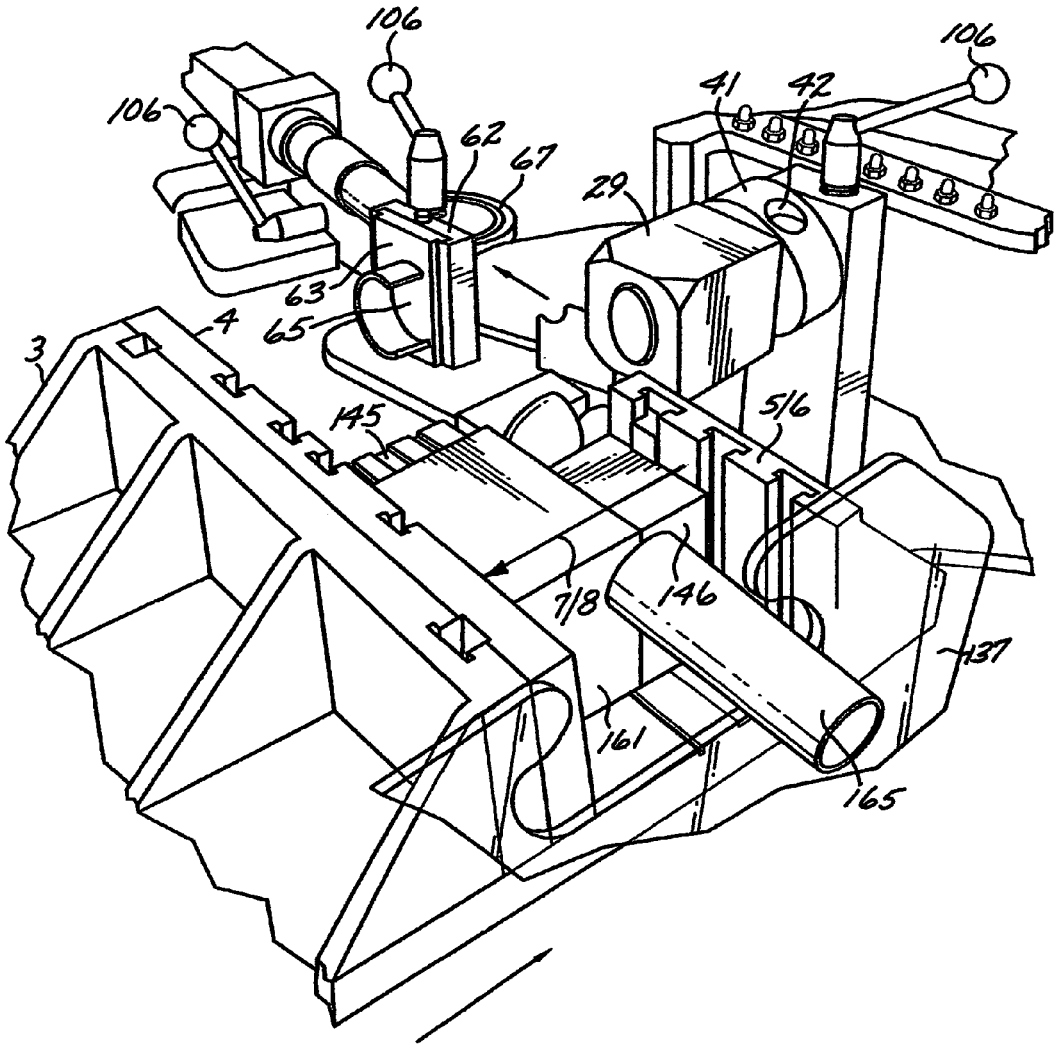
FIG. 3 is a partial perspective view similar to FIG. 2 showing the tube being formed held by the two grippers and the tube end locater tool retracted.

FIG. 1 is a perspective view of the tube forming apparatus 1 of the invention. Apparatus 1 is designed to be used for an infinite variety of tube end finishing tasks including straight or in bend forming, compound straight or in bend forming, tight exit forming, two step forming, straight or in bend coping. A tube end can be re-shaped to any configuration within its structural limits for a given application. Apparatus 1 has a clamping mechanism which works in conjunction with tube grips 8 to hold an object tube 165 in place for forming. FIG. 2 is a partial perspective view showing tube 165 located in place by tube end locator tool 63 and FIG. 3 is a partial perspective view showing tube 165 held by grippers 8 and locator tool 63 retracted. FIG. 4 illustrates forming tool holder 41 moving inwardly to initiate the forming of end of tube 165. For tubes that require forming in a bend, a specially designed tooling shoe is incorporated to support the bend radius. Once a tube 165 has been positioned, a radial swing arm assembly with a hydraulic ram mechanism is rotated to the desired angle for forming. The ram is then adjusted for proper tool alignment and depth for tube processing. This procedure is accomplished by using clamping grips and support shoe combinations. The support shoes are developed preferably in sets of five, consisting of 30, 45, 60, 75 and 90 degrees to accommodate various cut points on a tube bend radius. Costly machine setup times thus are significantly reduced by using locking handles, thumbscrews and locking knobs.

A description of the various components of apparatus 1 shown in FIGS. 6-24 is set forth hereinbelow.

A. Tube Gripping

Clamping table 2 is bolted to four mounting bosses, welded to the clamping mechanism structure. Four socket head cap screws are used to secure the table. The stationery grip holder assembly is narrow allowing parts with bends in close proximity to be held without holder interference. Four lateral grooves are cut into the top of the table on each side for placement of the stationery grip holder. The grip holder assemblies have a tang on the bottom, which fits into the table groove eliminating any slippage when gripping a tube. A T-slot is cut longitudinal on each side of the table in the center of each row of grooves and extends out thru the face of the table. Two T-slot bolts secure the grip holder assemblies to the table. To re-position the grip holder assembly longitudinally, the operator loosens the bolts slightly allowing the holder to be lifted and moved for rapid set-ups.

The clamping grip/shoe tool holder assembly 3 accepts a grip/shoe tool mounting adapter plate and allows the operator to use different adapter plates to change the lateral position of the grip tooling. The plate is mounted using two T-slots in the assembly face. When the lateral position is changed, the stationery grip holder is also changed. This insures proper alignment with opposing tooling.

Grip/shoe adapter plate 4 has four T-slots cut into the face for mounting the tubing grip and support shoe. The grip and shoe tools can be reversed from one side of the adapter/table to the other for tubes requiring compound forming.

Stationery grip holders 5 can be moved from one side of the clamping table to the other for parts requiring compound forming. The grip holder assembly is compatible and aligns with the grip/shoe adapter 4.

Stationery grip mounting directly to the tool holder 3 using T-slots eliminates lateral movement and provides additional clearance between form tools and grip holder brackets. This is important when forming small radius parts with 90 degrees of bend or more. Prior art machines typically use a horizontal slot in the stationery grip holder in conjunction with an adapter plate and grips with threaded mounting holes, the grips being bolted to the adapter and the adapter bolted to the stationery grip holder through the slot. The grip could be adjusted to accommodate various bend radius parts but often resulted in tube slippage when forming a part. In accordance with one of the teachings of the present inventions, lateral adjustments are accomplished on the work cylinder radial arm. This permits rapid tooling changeovers since little or no clamp position adjustments are required for many uses.

The tube grips 8 are made to hold a tube during the processing operation and the grip pairs, when placed together, positions the tube as close as possible to the grip holder 5. The tube support shoes 9 are made in segments, with a typical set consisting of five shoes ranging from 30-90 degrees in fifteen-degree increments. This provides ample support for any tube with a bend of 90 degree or more.

A clamping slide 10 is actuated by a hydraulic cylinder and scissor mechanism located in the main apparatus structure and has a longitudinal T-slot on the top surface where the clamping assembly fits thus maintaining alignment and allowing adjustment of the grip/shoe assembly. With the slide fully advanced the clamping pressure is adjusted using a screw in the end of the slide and is locked in place using two T-slot bolts.

The clamping adjustment screw 11 at the end of the slide 10 regulates the amount of pressure exerted on a tube during the clamping procedure.

B. Tube Positioning

Positioning fixture T-slots 12 to each side of the clamping table 2. This allows the mounting of adjustable or permanent mechanical tube positioning fixtures, an important feature for many applications when hydraulic tube end positioning is impractical.

C. Swing Arm

The main swing arm 14 has a hydraulic work cylinder having a ram assembly mounted therein and tool holder assembly mounted on top. The arm swings in a 180-degree circle from a pivot point in the center of the clamping table 2. This allows the operator to adjust the arm to the desired approach angle for forming or coping tubular parts. The ram stroke is fully adjustable in both directions. The ram has a rapid travel feature that allows the operator to control the approach speed to within close proximity of the tube, at which point it slows to a feed rate controlled by the operator. The work cylinder 17 is adjustable longitudinally and laterally allowing the operator to precisely align the work tool for part processing.

The swing arm table 15 is secured to the apparatus 1 using heavy-duty socket head cap screws allowing for easy removal and repair in the event of damage.

The work cylinder bed assembly 16 comprises two T-slotted ways, two pillow blocks, three thrust bearings, one lead screw, two rack gears, grease fittings and miscellaneous bolts and nuts. The ways have grooves at each end on the bottom where the rack gears are bolted in place. The pillow blocks are bolted to each end of the ways. The lead screw runs parallel between the apparatus surface through the work cylinder mounting blocks. With the assembly on the forming arm table, the rack gears protrude through the table, stopping any longitudinal movement when parts are being processed.

Work cylinder 17 rests on top of two bronze mounting blocks which extend down between the T-slotted surface. One block 18 is threaded for the lead screw and the other provides screw support. The blocks slide on top of the T-slotted surface. Four ⅝" T-slot bolts ride in the T-slots and protrude up thru the bronze blocks and thru the cylinder mounting ears. Locking handles secure the cylinder after being longitudinally positioned.

The lead screw pillow-blocks 18 house the lead screw bearings, one in front and one at the rear of the bed assembly. The blocks have holes at each end allowing them to be secured to the swing arm table 15 via T-slot bolts and locking handles after being laterally positioned.

Longitudinal adjustments of the work cylinder 17 are made using a lead screw allowing the operator to make more rapid adjustments.

Longitudinal hand wheel 20 makes adjustments to the work cylinder.

Graduated dial 21 on longitudinal adjustment lead screw facilitates precise positioning of the work cylinder. Each graduation on the dial represents 0.010" movement of the work cylinder. One complete turn (360°) of the wheel is equal to 0.200" thousands of an inch. The amount of lateral adjustment of the ram work cylinder bed assembly increased allows the operator to make adjustments for various tube radiuses without having to move the tube grips laterally and provides more flexibility when processing a wide range of tube parts.

A gear adjustment device 23 is coupled to the lateral adjustment mechanism of the bed assembly thus minimizing the amount of force required to make lateral adjustments to the work cylinder assembly. The device uses a large sprocket on the pinion shaft that drives the rack gears mounted under the ram table assembly. A small sprocket is mounted on an idler shaft below and is connected to the larger sprocket by a chain providing a smother action for more precise settings.

The work cylinder is laterally secured by slotting the work arm table and placing four T-slot bolts up through the table and lead screw mounts. Locking handles on top of the blocks secure the assembly to the table when in position.

A lateral hand wheel 25 makes adjustments to the work cylinder.

Swing arm base plate 26 incorporates a plate mounted at the base of the radial work arm. The plate has a radial T-slot around the perimeter of the top surface. There are two 180° radial scales (one for right side and the other for left side machine operation) engraved on the plate around the perimeter. These scales are placed at a 30° angle from horizontal to reduce glare.

Swing arm locking mechanism 27 has two floating bosses located in the swing arm structure one on each side of the swing arm. A pair of T-slot bolts ride in the radial base plate and extend up through the floating bosses. After the arm has been positioned at the desired angle, the floating bosses are secured to the base plate using two locking handles. The design eliminates any possibility of radial arm movement when forming or coping a part. The arm can be locked in any position in a 180° radius.

The height of radial work arm 83 at the pivot point is selected to increase overall strength and stability. Vertical movement at the end of the arm when forming parts has been substantially eliminated.

The work arm pivot 84 has been designed to insure proper bushing alignment by minimizing distortion when welding the arm assembly.

The work arm main structure 85 is designed using two vertical ribs instead of one thus adding lateral strength and stability to the overall assembly.

The ram stroke scale 92 indicates stroke depth; and longitudinal scale 93 indicates longitudinal position of the ram cylinder on the radial arm, The ram limit switch collar 95 with thumbscrew activates limit switch to stop ram, ram feed control switch collar 96 with thumbscrew activates and holds the limit switch in the activated position until ram reverses, the ram depth switch 97, when activated, stops the progress of the work cylinder ram and ram radial arm scales 99 indicate the approach angle position of the work cylinder arm when working the right or left side of apparatus 1.

D. Form Tool Orientation

A compound plane of form feature makes is possible to form a tube at any point in the bend radius at a compound angle. It allows the operator to adjust the compound, working angle of the form or cutting tools as much as 30°. When adjusted to the desired angle the tool is raised to the proper centerline height of the tube using the vertical adjustment screw. Adjusting the radial orientation of the compound head controls the plane of form. The plane of form assembly has a radial adjustment of 180°, which allows the creation of complex part configurations. By moving a part from one side of the clamping table to the other, it is possible to form a tubular part on any plane in a 360° circle. Compound tube forming requires a combination form tool assembly (Inner/Outer) to achieve the proper shape.

Combination form tools 29 are designed with an inner punch and outer form die. The clearance between the two tool pieces is equal to the tube thickness plus clearance. The inner punch and outer die work in concert to achieve the desired tube end shape.

Main tool holder assembly 30 comprises four main components, the radial face plate 31 and main body 33; tool holder slide housing 34 and tool holder slide assemblies 36.

Compound radial faceplate 31 is used to position the main tool holder assembly 33 at the desired plane for tube end forming. The plate floats on the piston rod and is locked in place using a stud, two pinch bosses and a locking handle. The plate has a 180° radial slot just inside and around the perimeter. There is a 180° scale on the outside surface of the plate to indicate the radial position of the main body. Two guide rods, one on each side, are provided to maintain ram piston rod and tool holder radial orientation. The rods extend back from the radial face plate and through bushings mounted on the side of the work cylinder. A single rod with two collars engage the work cylinder limit and feed rate switches allowing independent adjustment of each action. Alternately, two rods each with collars can be utilized.

Towers 32 are mounted over the work cylinder maintain switch collar orientation.

Main tool holder assembly 33 is screwed onto the work cylinder piston rod and is permanently locked in place using two pinch bosses. The body has a stud that extends through the slot of the compound radial faceplate and a hand locking knob and washer used to secure it to the compound faceplate. Loosening the locking handle and hand-locking knob allows plane of form adjustments. The assembly is rotated to the desired radial position and locked in place for tube forming or coping.

Tool holder slide housing assembly 34 mounts to a tongue on the main body assembly and pivots forward up to 30° for compound tube forming or coping. Adjustments are made using the compound angle adjustment shaft 35.

Tool holder slide assembly 36 is positioned behind a series of cam follower bearings in the tool holder slide housing 34. A mounting block is bolted to the slide and houses the form tool holder. The form tool holder rotates 360° in the mounting block and has a locking mechanism to secure it when in place. Because the slide assembly floats behind the cam follower bearings, the tool will follow the contour of a tube when being extracted after compound forming. Compound slide springs are used to return the slide to the home position after forming. Tool centering adjustments are made using the compound vertical adjustment screw.

Four additional cam follower bearings 37 add support for tool retracting.

A tool holder mounting block 38 houses the form tool holder assembly and includes a locking mechanism to secure the tool holder when in position. The locking mechanism utilizes two pinch bosses, a stud and locking handle. Block 38 is bolted to the slide, which is positioned behind the cam follower bearings in the tool holder housing assembly.

Compound slide springs 40 return the slide to the home, centerline position when operating on a horizontal plane, right or left.

The form tool holder 41 allows rapid tool changes by using a single locking eccentric, which engages the tool holder mounting boss and only requires approximately one quarter turn to release the tool. The tool holder 41 rotates on a 360° axis and has a 360° graduated scale around the perimeter to insure correct tool orientation.

The tool holder eccentric 42 turns in one direction when locking a form tool in place. This eliminates the possibility of damage to the tool-mounting boss when securing.

The tool holder scale 100 indicates the radial orientation of the work tool.

The compound angle adjustment shaft 35 is used to regulate the working angle of a form or cutting tool. The compound angle scale 102 indicates the angle at which a work tool will strike a tube. The compound vertical adjustment screw 103 is used to position the tool holder slide assembly in the compound tool holder housing and the compound slide scale 104 indicates the position of the tool holder slide assembly in the holder housing.

E. Tube Forming

Tubes requiring a compound form may have to exit an exhaust header flange on something other than a 90° plane. This is accomplished by first cutting the tube on the desired plane angle. The tool holder forming head is adjusted to the desired angle using the compound angular adjustment shaft. With the forming tool mounted in the tool holder, the tool holder slide assembly is raised to achieve the proper piston rod centerline height using the vertical adjustment screw. The radial forming arm angle is set and the appropriate lateral, longitudinal, cylinder position and ram depth adjustments are made. The part can now be formed with minimal resistance. This process enables complex shapes to be achieved. Tubes that exit an exhaust header flange and turn 90° or more with the straight tube section parallel to the exhaust flange surface and in close proximity due to space constraints in a vehicle also can be formed. First the compound head is rotated 90° right or left (depending on which side of the machine the work is being done), the radial arm angle is then adjusted to approach the apex of the tube radius and the compound head is adjusted to place the form tool face parallel to the cut face of the part. The part is then formed with minimal resistance. This process enables complex shapes to be achieved.

F. Tube Coping

Figure 5:
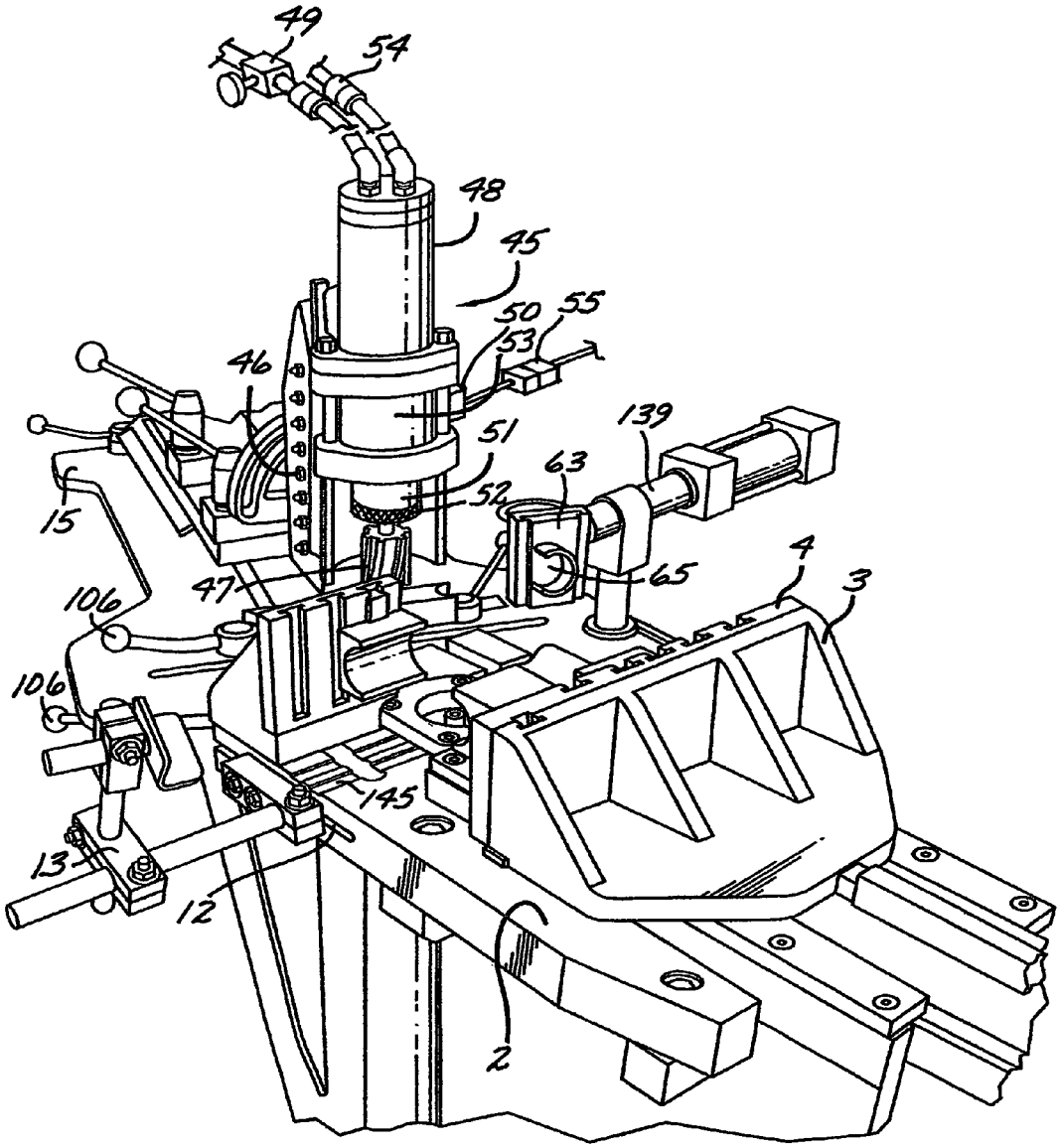
FIG. 5 is a partial perspective view showing the coping tool.
Figure 6:
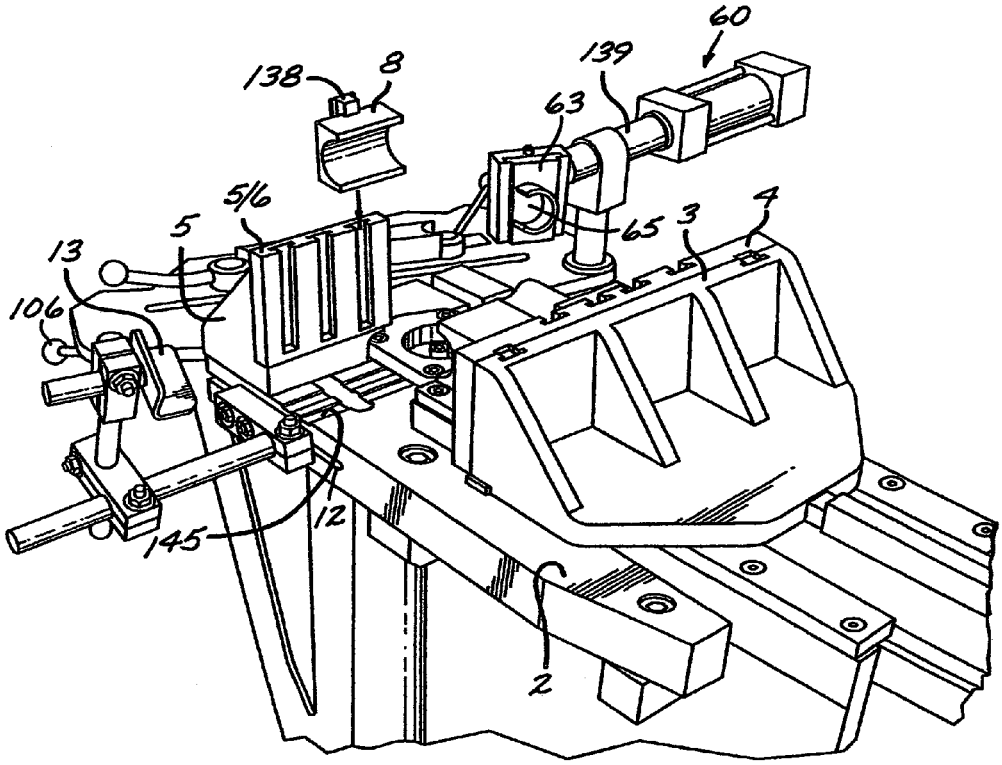
FIG. 6 is a partial perspective view of the forming area illustrating the ease in which the gripers can be changed.
Figure 7:
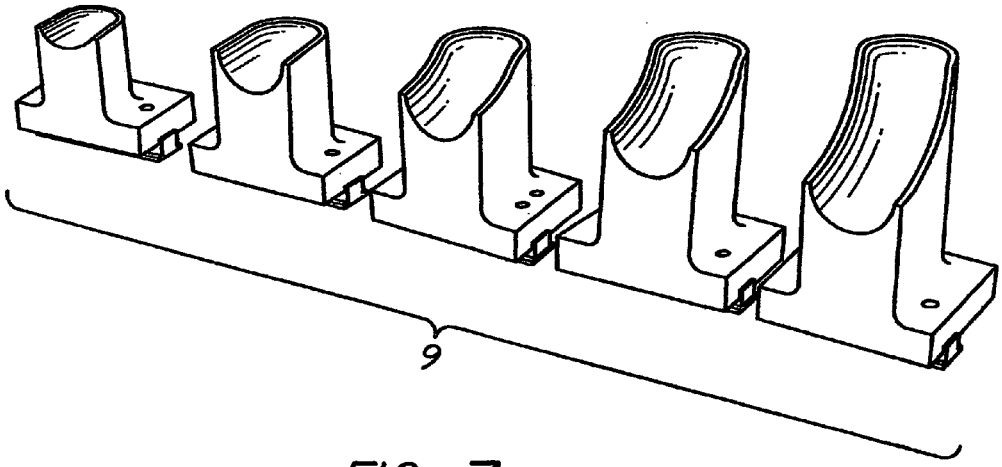
FIG. 7 is a partial perspective view of the different sized tube support shoes.
Figure 8:
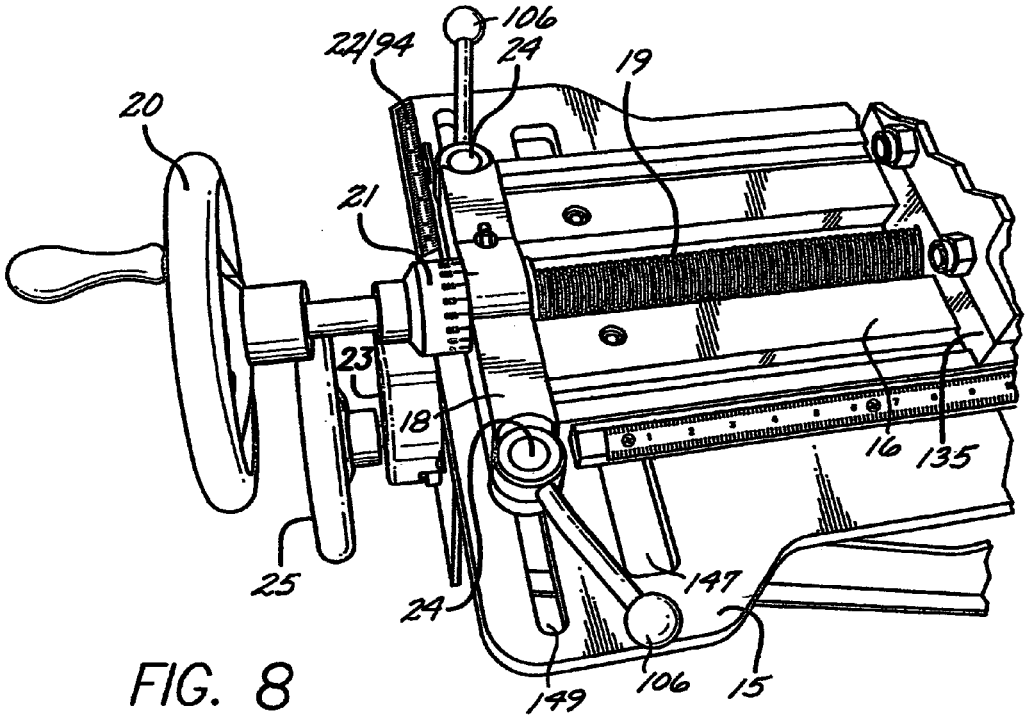
FIG. 8 is a partial perspective view of the rear of the machine of the present invention showing the hand wheel for longitudinal adjustment and a smaller hand wheel for lateral adjustment of the tools.
Figure 9:
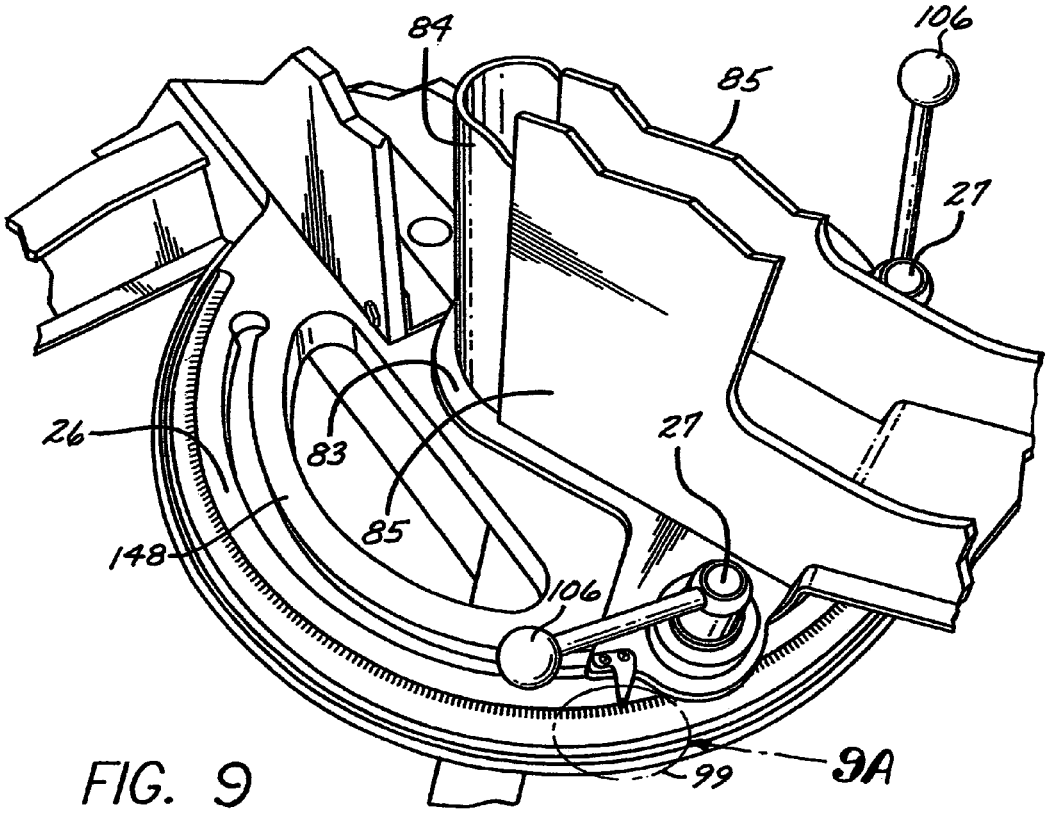
FIG. 9 is a partial perspective view of the machine base showing how the machine can be rotated and a scale for the correct setting.
Figures 9A, 10:
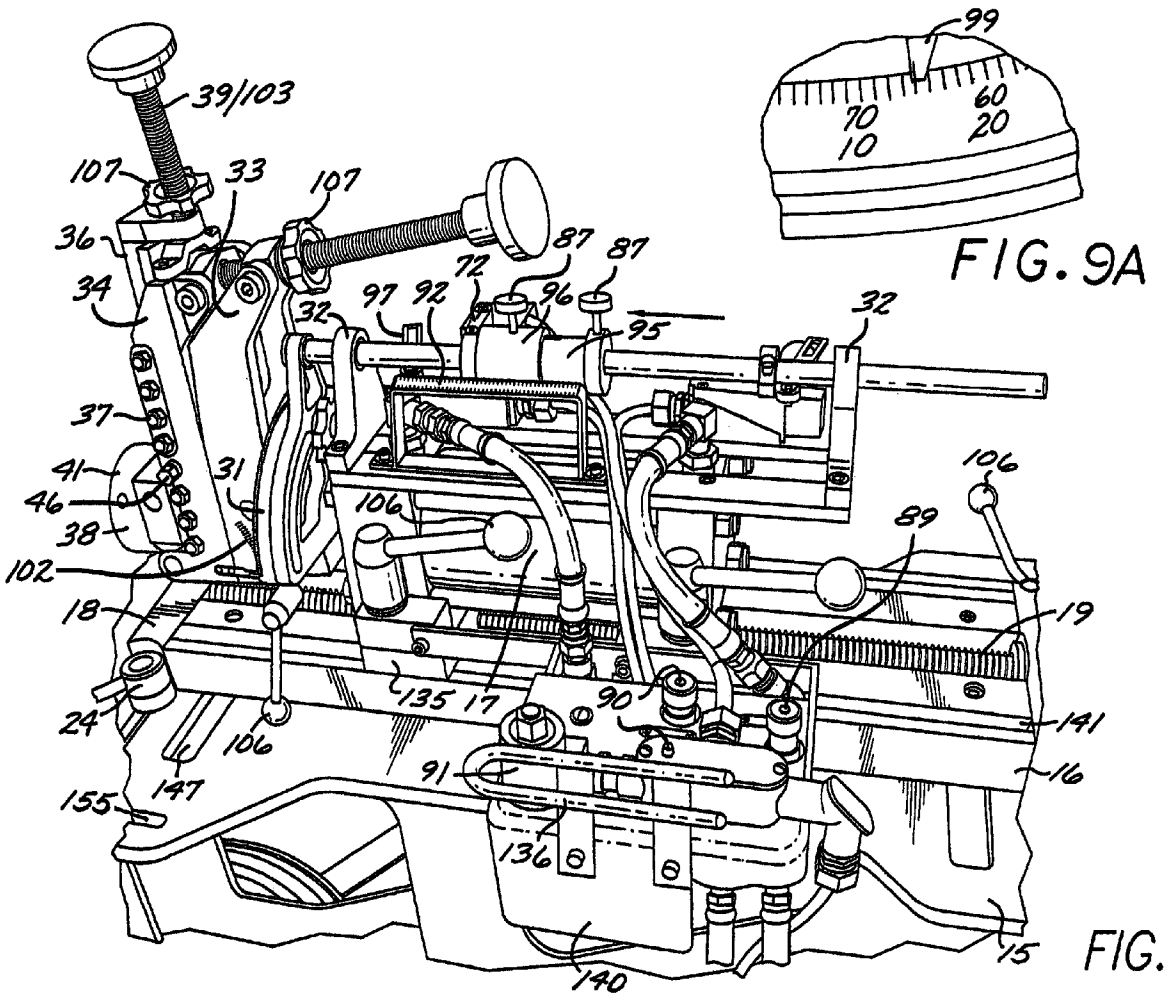
FIG. 9A is an enlarged view taken from FIG. 9 to show two scales.
FIG. 10 is a partial side perspective view of the machine of the present invention.
Figure 11:
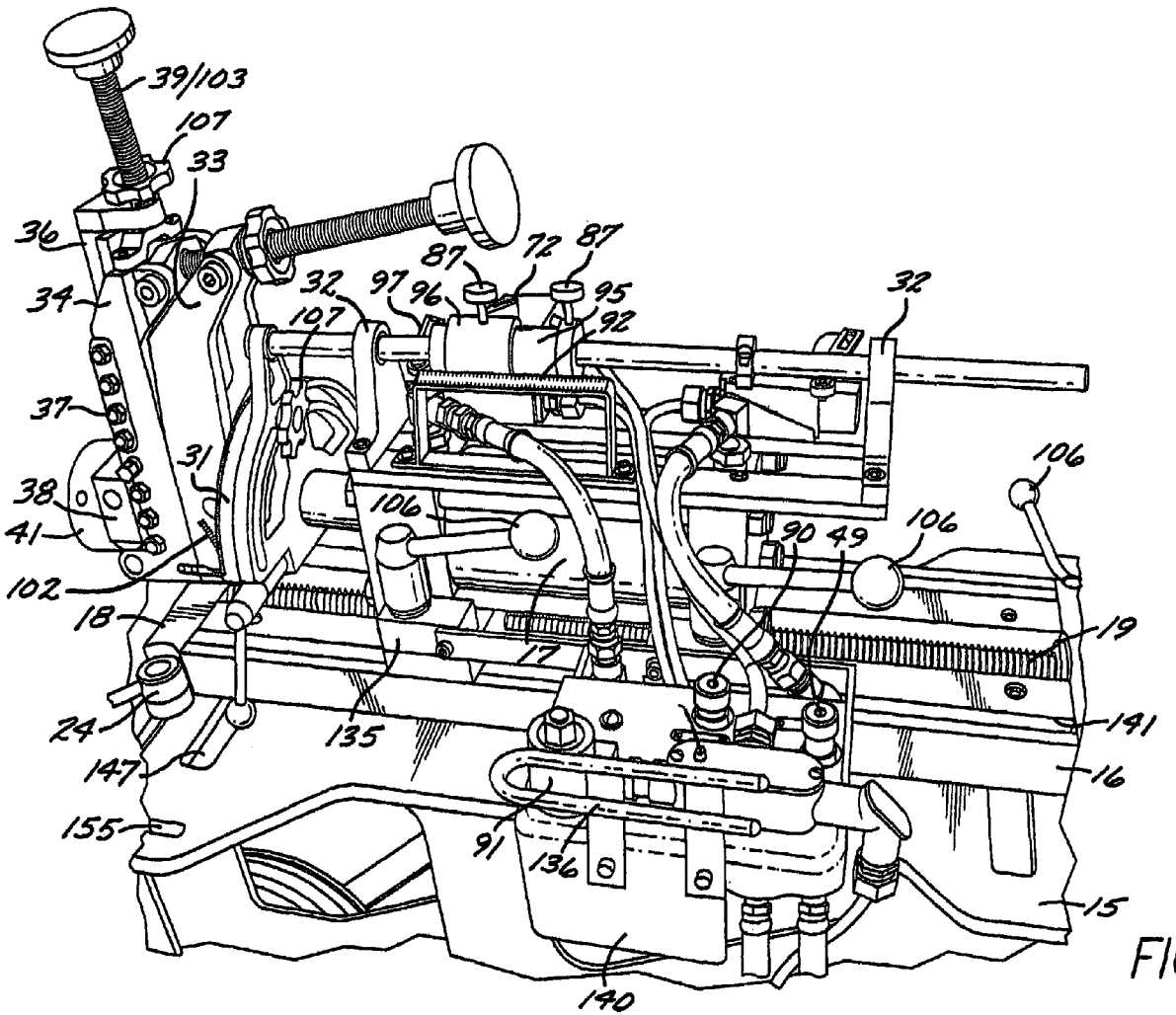
FIG. 11 is a partial side view similar to FIG. 10 showing some longitudinal movement.
Figure 12:
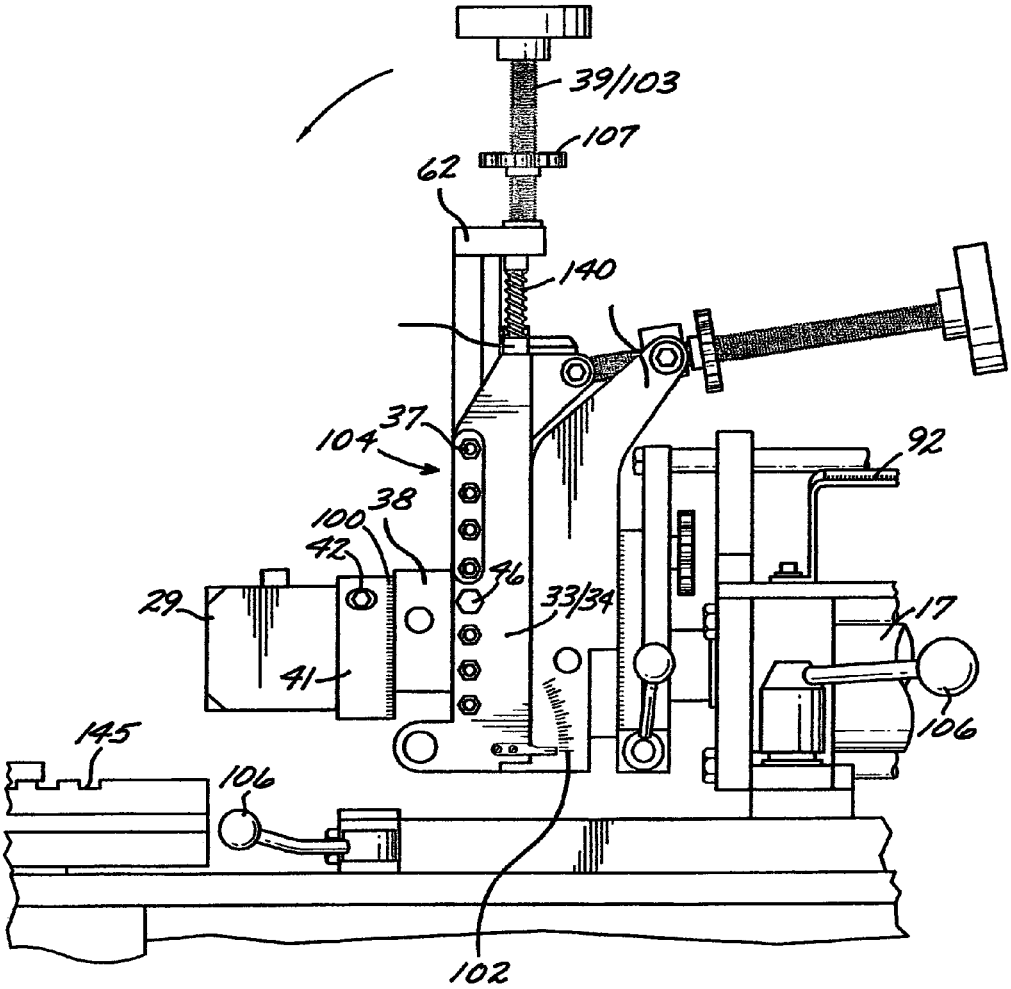
FIG. 12 is a side view of the forming tool, tool holder and the tool holder mounting block.
Figure 13:
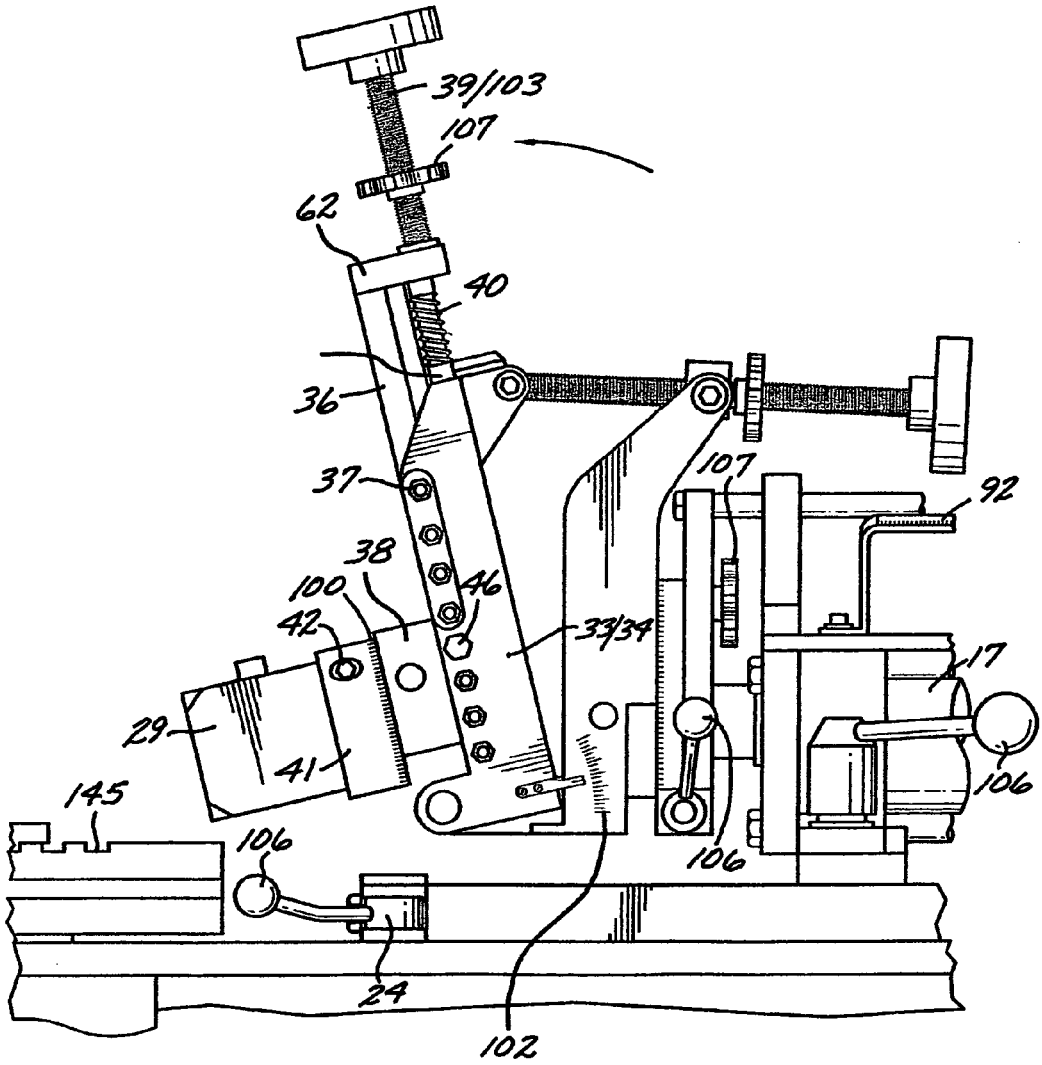
FIG. 13 is the same view as FIG. 12 showing the tool holder and forming tool being angled.
Figure 14:
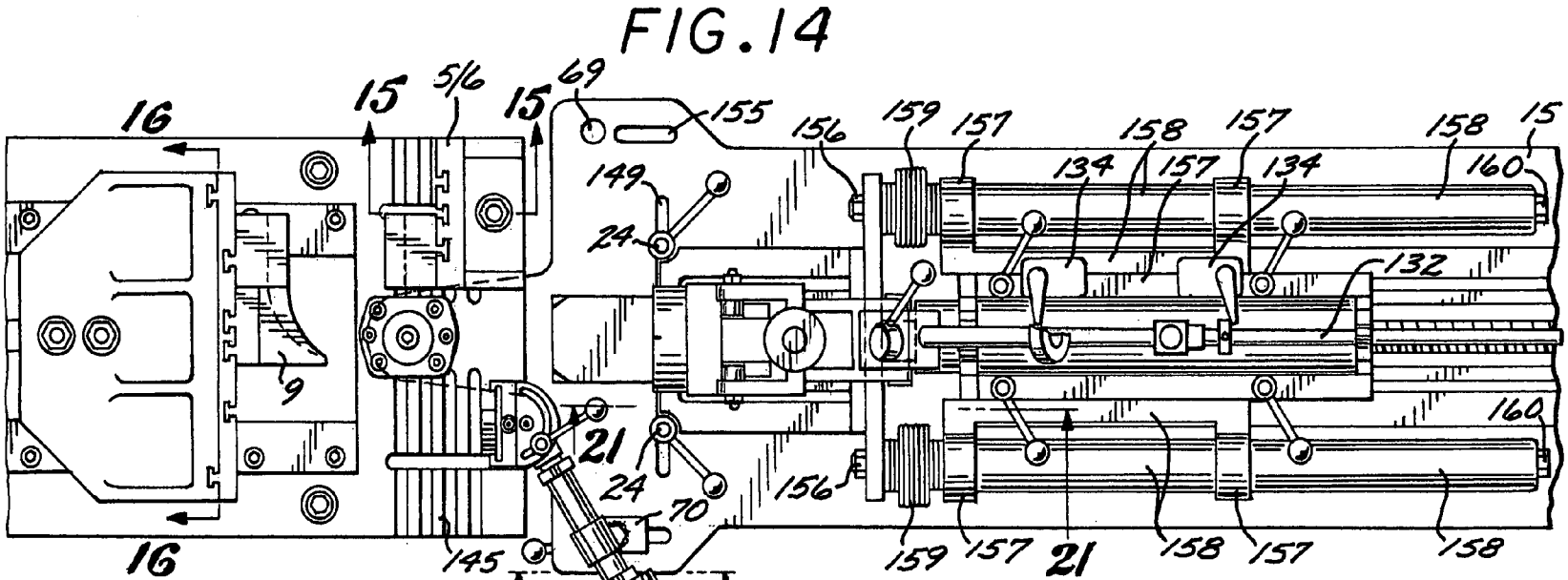
FIG. 14 is a top plan view of the machine of the present invention.
Figure 16:
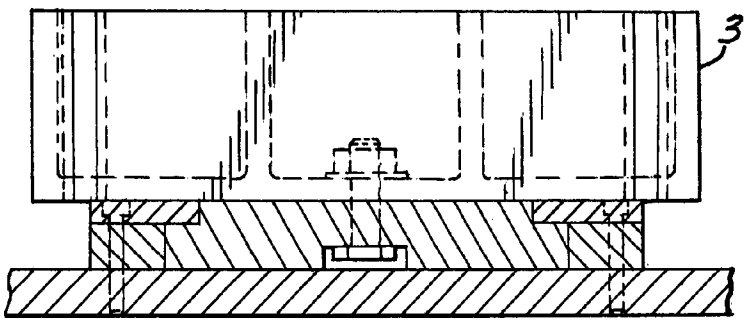
FIG. 16 is a cross sectional view taken on line 16-16 of FIG. 14.
Figure 15:
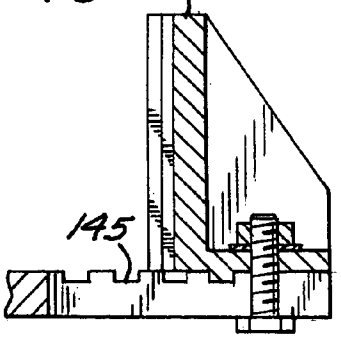
FIG. 15 is a cross-sectional view taken on line 15-15 of FIG. 14 illustrating the stationary grip holder locked in grooves formed in the table top.
Figure 14A:
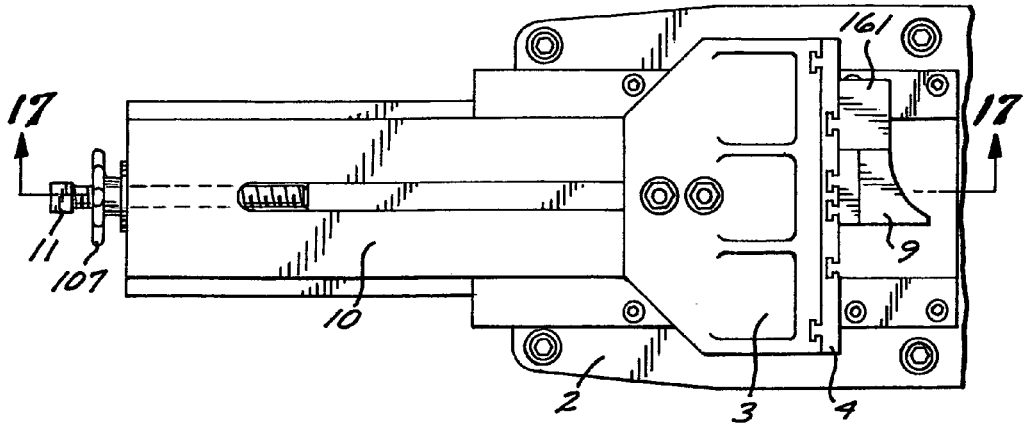
FIG. 14A is a top plan view of the left end of the machine shown in FIG. 14.
Figure 14B:
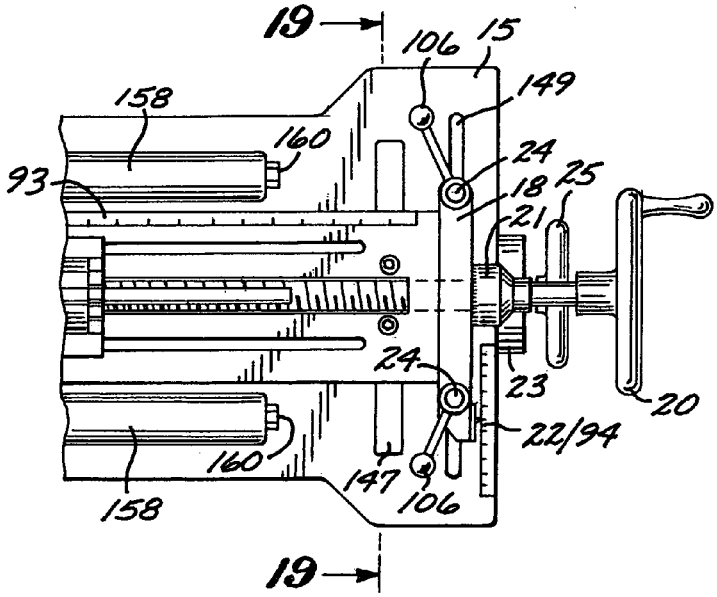
FIG. 14B is a top plan view of the right end of the machine shown in FIG. 14.
Figure 17:
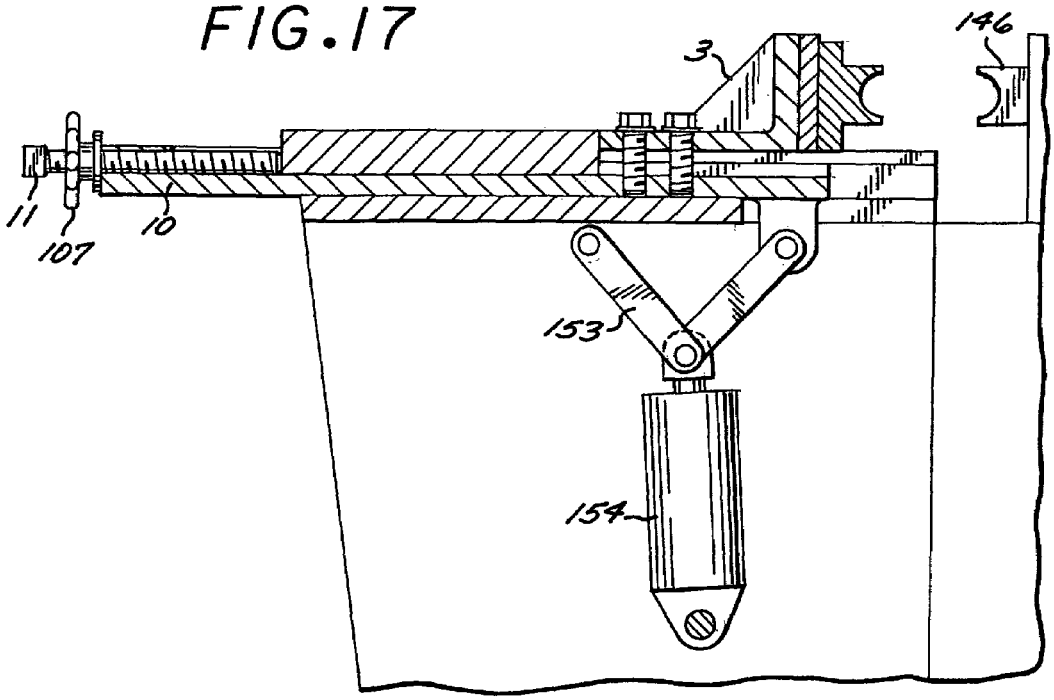
FIG. 17 is a cross sectional view taken on line 17-17 of FIG. 14A.
Figure 18:
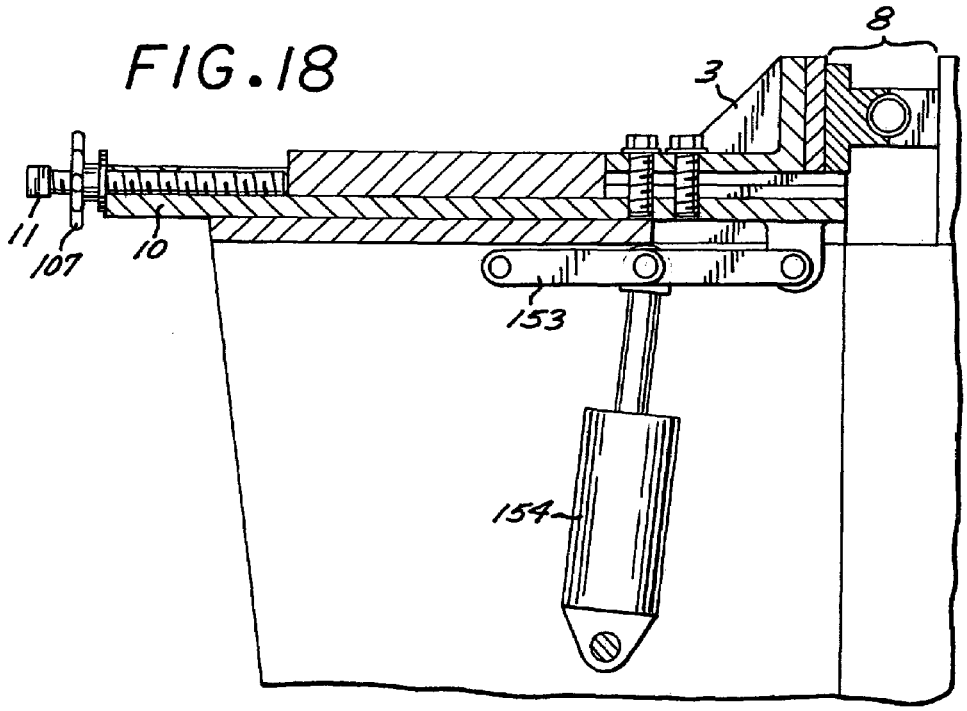
FIG. 18 is similar to the view in FIG. 17 but illustrates a further step in the tube forming process.
Figure 19:
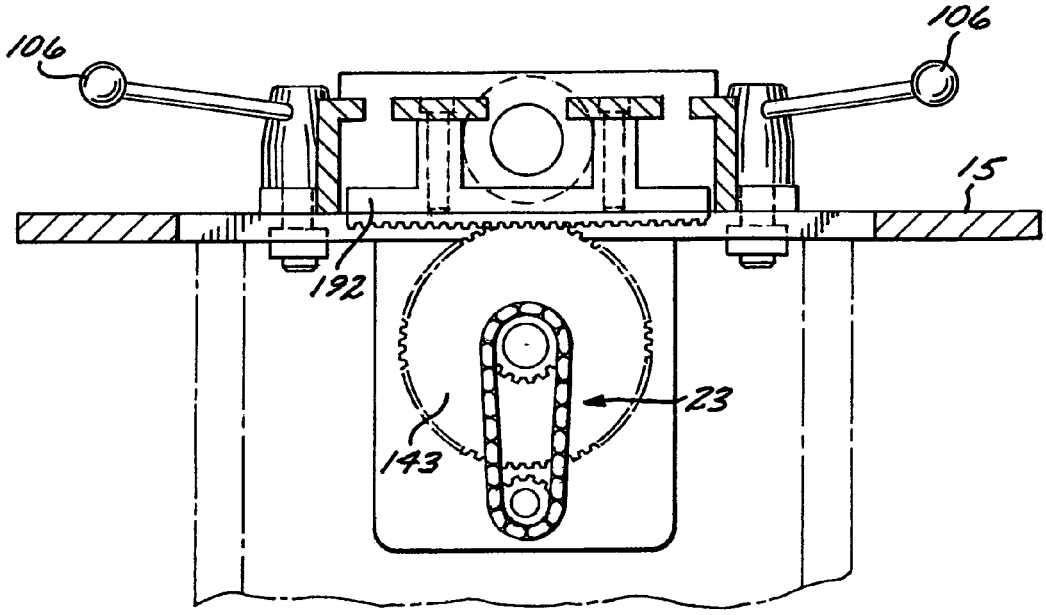
FIG. 19 is a cross sectional view taken on line 19-19 of FIG. 14B.
Figure 20:
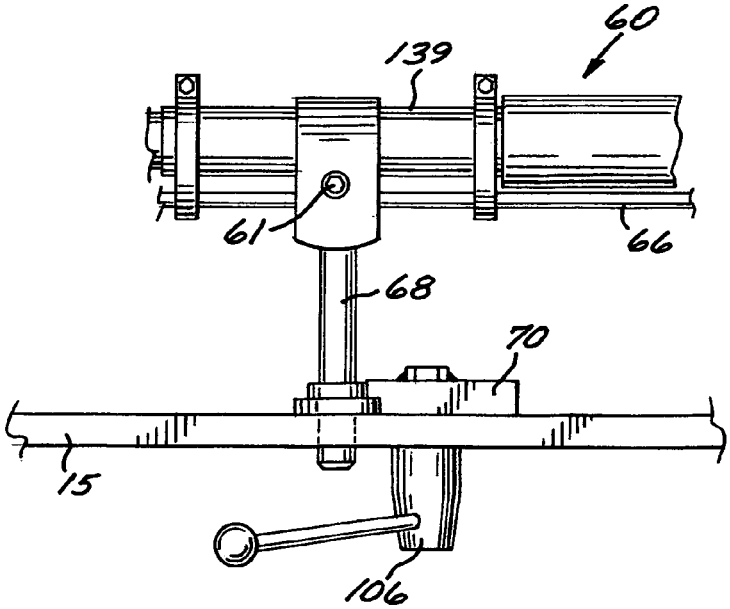
FIG. 20 is a side view of the tube end positioner assembly.

The tube coping tool attachment 45 (FIG. 5) is installed in place of the form tool holder slide assembly and is secured using two eccentric locks. The attachment 45 copes the trimmed end of a tube in the bend on an infinite number of angles. The attachment is driven by a hydraulic motor and has a quick-change cutting tool holder. Quick couplers are used to connect the hydraulic motor to the system. A quick release electrical plug is used to connect the RPM monitor located on the operator control console. The electrical connection sends a signal from an optical sensor mounted in the drive housing of the attachment to the RPM gauge mounted in the operator control console. This allows the operator to monitor the RPM of the cutting tool when setting up and processing parts.

Eccentric locks 46 are provided on the tool holder slide housing assembly to lock the coping attachment slide in place when being used. The locks stabilize the coping attachment for a smooth cutting operation. The coping tools 47 are held in place using a standard collet assembly.

Coping motor 48 is hydraulically operated and drives the cutting spindle at the operator adjusted RPM; the RPM is changed by using a pressure compensated flow control valve mounted over the hydraulic motor for convenient operator access.

An optical sensor 50 sends a signal to the RPM gauge on the operator control panel allowing the operator to monitor spindle speed (the spindle shaft has a piece of reflective tape attached; each time the tape passes the sensor it sends the signal to the control panel indicating revolutions per minute).

A collet assembly 51 grips the cutting tool shank when the collet nut is tightened and collet nut 52 is used to exert pressure on the collet and locks the cutting tool in place.

A coping tool mister 56 is utilized for lubricating the cutting tool when coping a tube. The mister comes on when the ram slows to the feed rate speed and shuts off shortly after reversing direction. A switch 105 shuts off the mister 56 when not in use.

FIGS. 25-35 illustrate the tube end forming steps utilized by the present invention. In particular, FIG. 25 shows tube end locator tool 63 locating tube 165 to be formed; FIG. 26 shows movable tube grip 161 positioned and gripping tube 165; FIG. 27 illustrates tube 165 being held between movable grip 161 and stationary grip 146; FIG. 28 shows tube end locator tool 60 retracted; FIG. 29 shows the end of tube 165 being formed, and FIGS. 30-35 show the results of various tube end forming operations.

G. Two Step Forming

A two step attachment 57 works in conjunction with machine mode 3 (described hereinafter). The attachment has an oblong faceplate with quick-change tool mounting holes at each end that accepts standard tool mounting bosses. The plate has a center pivot point and is bolted to a mounting plate. The mounting plate has a standard tool-mounting boss bolted to the back in line with the tool holder faceplate holes. The tool holder plate rotates 360°, and has a pair of machine handles, one on each side for easy indexing. Tools are indexed to the center of the ram cylinder where detent bearings alert the operator of the tool position.

H. Tube End Positioning

The tube end positioner assembly 58 is fully adjustable and hydraulically operated; it is used to quickly and accurately locate a tube end in the stationary tube grip for clamping. Tools are designed to locate a tube on the proper plane and in the correct lateral position for precise support shoe positioning when being clamped. Once located, the opposing clamp grip and shoe is advanced to hold and support the tube in place for processing. This step is important since the tube support shoe must be precisely positioned against the tube in order to provide proper support when processing. The positioner is easily moved from one side of the forming arm table to the other to accommodate parts requiring compound forming.

Positioner setups 59 are made with the machine in the manual mode (described hereinafter) and the part is clamped in the desired position, the positioner tool being located against the part. The hold down finger is slid over the positioner-mounting flange guided by a key, which, protrudes down at the back of the finger, into a longitudinal slot. The tower is then secured using the finger locking handles. The hydraulic cylinder tube and tool holder assembly are secured using a locking handle. If a part has a shallow bend at the end to be processed, establishing the proper horizontal plane of bend is difficult using the tube end positioner 58. Some part configurations are not suited for tube end positioning; therefore T-Slots are provided in the clamping table to mount adjustable or permanent mechanical tube positioning fixtures.

The positioner assembly hydraulic cylinder is mounted in a tower allowing linear cylinder adjustment. Once the linear adjustment has been made, a locking mechanism is used to secure the cylinder in place. Mounting tower 61 uses a locking mechanism to secure the cylinder tube in place after positioning. This mechanism consisting of two pinch bosses, a stud, flat washer and locking handle.

The tool holder assembly housing 62 is mounted on the end of the cylinder rod and houses the tube end locator tool 63. A simple tool is required for each tube diameter.

The tube end locater tool 63 is a flat mounting plate with a hole in the center and a horseshoe shaped plate attached. The inside diameter of the horseshoe plate is equal to the diameter of the tube being processed. Tools are housed in the tool holder assembly and held in place using a spring-loaded pin. A spring loaded block 64 is centered vertically in the tool holder assembly using two compression springs and two shoulder screws, one on top and one on the bottom, allowing slight vertical movement. This feature minimizes the possibility of damage to the tool holder assembly if a part moves vertically when being clamped.

Tool installation is accomplished by depressing the mounting pin with any pointed object, the tube end locator tool 63 is then slid into the tool holder assembly over the pin into position, and the pin is released into the hole creating a positive lock.

The tool holder assembly 62 rotates 180° on a horizontal plane to accommodate an infinite variety of cut and bend angles.

Hold down fingers 70 are used to secure the positioner tower assembly 60 to the table when in place for a production run. Hold down-fingers have a bolt that protrudes thru the table slot with a washer and locking handle to secure the assembly to the table.

The hold-down fingers 71 are held up using compression springs, allowing the operator to simply slide the finger over or away from the tower flange without lifting.

I. Rapid Travel

The rapid travel feature of the present invention reduces cycle times and precisely controls approach and feed rates for forming and cutting. The rapid travel feature allows the operator to advance the work cylinder ram at the maximum rate of speed to within close proximity of the part; thereafter the ram slows to the selected working feed rate set by the operator. The rapid travel speed is controlled using a flow control valve, which meters fluid entering the rear port of the work cylinder allowing the operator to control the approach speed. The working feed rate speed is controlled using a flow control valve, which meters fluid exiting the front port of the work cylinder. The change of speed from rapid travel to feed rate is accomplished by directing fluid from the front port of the work cylinder through the flow control valve and a solenoid operated shut off valve simultaneously. The fluid exits the cylinder and flows through the shutoff and flow control valves merging downstream. When the shutoff valve is energized hydraulic fluid is diverted through the flow control valve. The operator adjusts the flow control valve to the desired feed rate. The shutoff valve is energized when the first of two limit switches is activated. The limit switch is mounted inline but before the maximum stroke limiting switch. A set of collars on the work cylinder guide rod is designed to strike and activate the limit switches. The inner collar is adjusted to strike and activate the second switch achieving the desired tool depth. The outer collar is mounted on the outside of the existing collar and is adjusted to strike and activate the first limit switch just prior to the tool making contact with the part. The switch remains activated until the ram retracts and the collar clears the switch. When the second limit switch is struck, the ram either stops or reverses and returns to the retracted position depending on the machine mode.

When initiating a forming operation, the machine is placed in the manual mode, the part to be processed is clamped in place and the ram depth is set using the inside limit switch collar. The ram is then manually advanced to within close proximity of the part, the outer switch collar is then shifted forward to make contact with the first limit switch. When the switch is energized, an indicator light on the speed/feed control enclosure comes on indicating to the operator where the ram will slow to the feed rate speed when processing a part. The operator cycles the machine in the manual mode while adjusting the flow control valves to the desired speed and feed rates (note that all adjustments are made without the use of hand tools).

Thumb screws 87 make ram depth adjustments, eliminating the need for wrenches.

The ram speed control valve 89 located at the inlet end of the ram cylinder controls the flow rate of hydraulic fluid, ram feed control valve 90 located at the outlet end of the ram cylinder controls the flow rate of hydraulic fluid, ram solenoid valve 91 located at the outlet end of the ram cylinder diverts fluid thru the ram feed control valve when activated, ram feed switch 98, when activated, energizes the rapid travel shutoff valve and slows the ram to the adjusted feed rate. Light 109 indicates when the feed rate limit switch is activated to slow the ram cylinder.

J. Power

Power unit 74 consists of a hydraulic oil tank, motor, pump, flow gauge, four 4-way hydraulic control valves and computer modules to control all machine functions.

K. Machine Operating Modes

1. Machine mode one provides independent control of each machine function using buttons on a control console. This mode is used for machine setups and testing.

2. Machine mode two provides single step semi-automatic forming. The part end to be processed is placed in the positioner tool (position tool deactivated if not required). The shoe/grip holder is advanced manually until the tube is fully clamped. The cycle begins automatically. The positioner tool retracts, the work cylinder advances to the forward limit switch and the work cylinder then retracts to the rear limit switch. The part is unclamped and the operator removes the part from the machine. The tube end positioner returns to the start position after an operator controlled timed delay.

3. Machine mode three provides two-step semi-automatic forming. The two-step semi-automatic feature allows efficient processing of parts that require two operations. For example, some parts require a form step and then a step where a tube is pressed into the formed part end. The part end to be processed is placed in the positioner tool (position tool deactivates if not required). The shoe/grip holder is advanced manually until the tube is fully clamped and the cycle begins automatically. The positioner tool retracts, the work cylinder advances to forward limit switch, the work cylinder then retracts to the rear limit switch while the part remains in the clamped position and the positioner stays in the retracted position. The operator shifts the multi tool holder accessory to the second position. The work cylinder forward button on the control console is depressed and the cycle continues. The work cylinder advances to the forward limit switch and retracts to the rear limit switch. The part is unclamped and the operator removes the part from machine. The tube end positioner returns to the start position after an operator controlled timed delay. This feature holds the part in place until the second step is complete, shortening cycle times considerably.

4. Machine mode four provides a single stroke semi-automatic tube end coping. The part end to be coped is placed in the positioner tool (position tool deactivated if not required). The shoe/grip holder is advanced manually until the tube is fully clamped. The cycle begins automatically with the positioner tool retracting. The coping motor starts and the work cylinder advances rapidly to the first limit switch. The ram slows to the feed rate set by the operator and a tool mister starts. The ram advances to complete the cutting phase. The work cylinder retracts to the rear limits witch and the coping motor and tool mister stops. The part is unclamped and removed from the machine. The positioner returns to the start position after an operator controlled timed delay.

L. Controls

FIG. 36 is a plan view of the control panel 129 used in the apparatus of the present invention.

A microprocessor (not illustrated) operates in conjunction with the control panel buttons/switches to perform the functions set forth hereinafter.

E-Stop Button 110 when depressed, deactivates the control console and shuts off the hydraulic pumping unit.

Start position button 111—once the machine has been setup for production in the manual mode, the operator selects the desired mode for production and depresses this button, which moves the clamp cylinder, work cylinder and position cylinders into their starting positions.

Position cylinder lockout switch 112—with this switch in the off position, the action of the position cylinder is fully active in manual or auto modes. With the switch in the on position, the cylinder is placed in a retracted position and is non functional in all modes.

System Off button 113—this button, when depressed, deactivates the complete control console but leaves the hydraulic pumping unit on.

System On button 114—this button, when depressed, activates all functions of the control panel.

Clamp Cylinder Out button 115—with the machine in manual mode, button 115 is used to advance the clamping mechanism to grip a part. In modes two, three and four, as described hereinabove, button 115 is used to advance the clamping mechanism and starts the auto cycle when the part is fully gripped.

Clamp Cylinder in button 116—with the machine in manual mode, button 116 is used to retract the clamping mechanism to release a part. In all modes the clamping mechanism retracts when the forming or cutting cycle is complete.

Work Cylinder Out button 117—with the machine in manual mode button 117 is used to advance the work cylinder. In mode three only, button 117 is used to complete the two-step cycle.

Work Cylinder In button 118—with the machine in manual mode this button is used to retract the work cylinder and tool holder mechanism.

Position Cylinder Out button 119—this button extends the position cylinder rod and tube positioning mechanism in the manual mode.

Position Cylinder In button 120—this button retracts the position cylinder rod and tube positioning mechanism in the manual mode.

Coping Motor On button 121—this button starts the coping attachment motor in manual mode only.

Hydraulic Power On button 123—this button turns on power to hydraulic unit.

Hydraulic Power Off button 124—this button turns off power to hydraulic power unit.

Mode Switch 125—this switch controls machine modes one (manual), two (single step auto), three (two step auto) and four (single step coping).

Part Counter 126—this counter adds one to the count after each part is clamped (a button allows the operator to reset the counter to zero after a production run).

RPM Gauge 127—this gauge monitors the revolutions per minute of the coping attachment motor using a digital readout.

Timer 128—in modes two, three and four, the timer allows the operator to control the amount of time required to remove a part from the grips before the position cylinder mechanism returns to the start position at the completion of a cycle. The time delay can be adjusted from 0 to 15 seconds.

FIG. 37 is a view along line 37-37 of FIG. 21 illustrating tool head assembly 33 being rotated to seven different positions (a total of 180°) and FIG. 38 is a perspective view of the tool head 33 rotated and tilted in position for the forming operation. FIGS. 39 and 40 illustrate the end of a tube after the forming operation. FIG. 41 is a perspective view illustrating the tool head assembly 33 rotated from the position shown in FIG. 38 and FIG. 42 illustrates a formed tube end produced after the tool head assembly 33 is rotated to the position shown in FIG. 41 to enable the forming head to form the tube end. FIG. 43 illustrates the forming head die 29 coupled to tool holder 41, holder 41 in turn housed by mounting block 38. Block 38 is coupled to tool holder slide housing assembly 34 which in turn is coupled to main tool holder assembly 33. Mounting block 38 is bolted to tool holder slide assembly 36.

FIG. 44 shows the tube coping attachment 45 connected to the tool holder slide assembly 36 after mounting block 38 with the tool form die 29 connected thereto is removed. Eccentric locks 46, attached to the tool holder slide assembly 36, locks tube copy attachment 45 in place when being used. Coping tool 47 is held in place using a conventional collet assembly 51. Spindle housing 53 provides, inter alia, structural integrity to attachment 45.

FIGS. 45 and 46 illustrate coping tool 45 installed and in position to make a cut in the end of tube 165.

FIG. 47 is a plan view showing the pipe 165 after being coped and FIG. 48 illustrates a pipe that has been coped joined to another pipe 165. FIG. 49 is a top plan view showing the tool head assembly 33 rotated with the coping tool so that the tube end can be coped in a different plane. FIG. 50 is a bottom view of a pipe 165 having the coping provided by the coping tool shown in FIG. 49 and FIG. 51 is a perspective view of the pipe 30 shown in FIG. 50 fitted to another pipe 165. FIG. 52 further illustrates the versatility of the apparatus of the present invention and, in particular, pipe 165 being coped at an oblique angle and fitted to another pipe 165. Finally, FIG. 53 illustrates positioner tool holder assembly 62, locator tool 63 being shown ready to be positioned for tube end locator tool 63, into channels, or recesses, formed in assembly 62. A positioner spring loaded block 64 accurately aligns located tool 63 when inserted into assembly 62 minimizing the possibility of damage to assembly 62 if a part moves vertically when being clamped.

Figure. 54 illustrates the tool holder slide assembly 36 being secured to tool holder slide housing assembly 34 and FIG. 55 illustrated tube coping attachment 45 attached to coping motor mounting plate 168, plate 168 being secured to tool holder slide housing assembly 34 via eccentric locks 46. FIG. 56 illustrates how form tool 29 is connected, via mounting bars 167, to form tool holder 41. A tool holder eccentric 42 which preferably turns in a single direction locks form tool 29 in place.

The apparatus of the present invention provides a four axis and fine linear movement capability as follows:

Axis

1. Tool holder rotation adjustment (180 degrees)
2. Compound angle adjustment (30 degrees)
3. Compound plane adjustment (180 degrees)
4. Main swing arm adjustment (180 degrees).

Linear

1. Tool holder slide positioning (4.5 inches)
2. Work cylinder lateral movement (6.0 inches)
3. Work cylinder longitudinal movement (18 inches)
4. Tube grips and shoe positions lateral direction (essentially infinite within machine parameters using various adapters)
5. Tube grips and shoe positions, longitudinal direction (4 inches).

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. Apparatus for both forming and coping a tube end and having a longitudinal axis comprising:

a table having first surface;

means for gripping a tube located at a first position on said table surface such that an end of the tube is positioned to be formed;

a movable carriage assembly having a first tool assembly mounted thereto, said first tool assembly being positioned adjacent said tube end, said movable carriage assembly being rotatable about said longitudinal axis and to a predetermined plane relative to said axis;

means for controlling said movable carriage assembly wherein said first tool assembly forms said tube end;

means for enabling said first tool assembly to be removed from said movable carriage assembly; and a second tool assembly mounted to said movable carriage, said second tool assembly comprising cutter means, said controlling means moving said carriage into contact with said tube end whereby a cut is formed in said formed tube end.

2. A method for both forming and coping a tube end comprising the steps of:

providing a table having first surface;

gripping a tube located at a first position on said table surface such that an end of the tube is in position for forming, said tube gripping location being adjustable to a second position on said table surface;

providing a movable carriage assembly having a first tool assembly mounted thereto, said first tool assembly being positioned adjacent said tube end, said movable carriage assembly having a longitudinal axis;

rotating said movable carriage assembly about said longitudinal axis to a predetermined plane relative to said axis whereby said first tool assembly forms said tube end;

removing said first tool assembly from said movable carriage assembly;

mounting a second tool assembly mounted to said movable carriage, said second tool assembly having a cutter; and moving said carriage into contact with said tube end whereby a cut is made in said formed tube end.

3. Apparatus for forming a tube end and having a longitudinal axis comprising:

a table having first surface;

means for gripping and supporting a first tube located at a first position on said table surface such that an end of the tube is positioned to be formed;

a movable carriage assembly having a first tool assembly mounted thereto, said first tool assembly being positioned adjacent said tube end, said movable carriage assembly being rotatable about said longitudinal axis to a predetermined plane relative to said axis;

means for controlling said movable carriage assembly wherein said first tool assembly forms said tube end; and means for enabling said first tool assembly to be removed from said movable carriage assembly.

4. A method for forming an end on a first tube member comprising the steps of:

providing a table having a first surface;

gripping said first tube member at a first predetermined position on said table surface such that an end of said first tube is in position for forming;

providing a movable carriage assembly having a first tool assembly mounted thereto, said first tool assembly being positioned adjacent said first tube member end, said movable carriage assembly having a longitudinal axis and being rotatable thereabout to a predetermined plane relative to said axis; and controlling said movable carriage assembly wherein said first tool assembly forms the end of said first tube member.

* * * * *